US010745983B2

(12) United States Patent
Van Der Hoorn et al.

(10) Patent No.: US 10,745,983 B2
(45) Date of Patent: Aug. 18, 2020

(54) DRILLING INSTALLATION; HANDLING SYSTEM, METHOD FOR INDEPENDENT OPERATIONS

(71) Applicant: GustoMSC Resources B.V., Schiedam (NL)

(72) Inventors: Josephus Leonardus Aloysius Maria Van Der Hoorn, Schiedam (NL); Naxin Zhang, Schiedam (NL); Mark Cornelius Marinus Franciscus Rommens, Schiedam (NL); Govert Hendrik Teunis Zijderveld, Schiedam (NL)

(73) Assignee: GustoMSC B.V., Schiedam (NL)

( * ) Notice: Subject to any disclaimer, the term of this patent is extended or adjusted under 35 U.S.C. 154(b) by 40 days.

(21) Appl. No.: 15/571,710

(22) PCT Filed: May 4, 2016

(86) PCT No.: PCT/NL2016/050322
§ 371 (c)(1),
(2) Date: Nov. 3, 2017

(87) PCT Pub. No.: WO2016/178576
PCT Pub. Date: Nov. 10, 2016

(65) Prior Publication Data

US 2018/0155995 A1 Jun. 7, 2018

(30) Foreign Application Priority Data

May 4, 2015 (NL) ..... 2014765
Jan. 5, 2016 (NL) ..... 2016059

(51) Int. Cl.
*E21B 19/087* (2006.01)
*E21B 19/22* (2006.01)
(Continued)

(52) U.S. Cl.
CPC ..... *E21B 19/22* (2013.01); *E21B 15/003* (2013.01); *E21B 15/02* (2013.01); *E21B 19/008* (2013.01);
(Continued)

(58) Field of Classification Search
CPC ..... E21B 19/14; E21B 19/087; E21B 19/143
(Continued)

(56) References Cited

U.S. PATENT DOCUMENTS 4,044,858 A 8/1977 Vikre
4,401,398 A 8/1983 Remson
(Continued)

FOREIGN PATENT DOCUMENTS

CN 202295237 U 7/2012
CN 104060951 A 9/2014
(Continued)

OTHER PUBLICATIONS

GustoMSC: "GustoMSC SmartCrane",, May 2, 2016 (May 2, 2016), XP054976864, Retrieved from the Internet: URL:https//:// www.youtube.com/watch?v=3ISMmu kG_3U [retrieved on Oct. 27, 2016].
(Continued)

*Primary Examiner* — Kenneth L Thompson
(74) *Attorney, Agent, or Firm* — Banner & Witcoff, Ltd.

(57) ABSTRACT

Drilling installation comprising a cantilever with a drilling floor for performing drilling operations; further comprising an independent operations handling system arranged for handling equipment underneath the drilling floor independent of the drilling operations on the drilling floor, wherein the independent operations handling system comprises a handling element for cooperation with the equipment to be handled, wherein the handling element is extendible underneath the cantilever.

23 Claims, 22 Drawing Sheets

(51) Int. Cl.

| | |
|---|---|
| ***E21B 15/02*** | (2006.01) |
| ***E21B 15/00*** | (2006.01) |
| ***E21B 19/00*** | (2006.01) |
| *E02B 17/00* | (2006.01) |
| *E02B 17/02* | (2006.01) |

(52) U.S. Cl.
CPC ..... *E02B 17/021* (2013.01); *E02B 2017/006* (2013.01)

(58) Field of Classification Search
USPC ..... 166/358
See application file for complete search history.

(56) References Cited

U.S. PATENT DOCUMENTS

| | | | | |
|---|---|---|---|---|
| 5,248,003 | A | 9/1993 | Song et al. | |
| 6,220,807 | B1 * | 4/2001 | Sorokan | E21B 19/155 414/22.62 |
| 6,343,892 | B1 * | 2/2002 | Kristiansen | E21B 15/00 405/195.1 |
| 6,491,174 | B1 | 12/2002 | Day | |
| 8,997,878 | B2 * | 4/2015 | Brown | E21B 19/004 166/341 |
| 9,121,235 | B2 * | 9/2015 | Orgeron | E21B 19/087 |
| 9,617,796 | B2 * | 4/2017 | Hall | E21B 15/00 |
| 2005/0092497 | A1 | 5/2005 | Rashid et al. | |
| 2008/0044234 | A1 | 2/2008 | Morrison et al. | |
| 2008/0253866 | A1 * | 10/2008 | Lops | E21B 19/155 414/22.55 |
| 2009/0274543 | A1 | 11/2009 | Grotherr et al. | |
| 2010/0263879 | A1 | 10/2010 | Cochran | |
| 2010/0303586 | A1 * | 12/2010 | Hankins | E21B 19/14 414/22.51 |
| 2016/0102508 | A1 * | 4/2016 | Fox | E21B 19/14 175/52 |
| 2017/0067303 | A1 * | 3/2017 | Thiemann | E21B 3/02 |
| 2017/0074056 | A1 * | 3/2017 | Roodenburg | B63B 35/4413 |

FOREIGN PATENT DOCUMENTS

| | | | |
|---|---|---|---|
| EP | 2243922 | A2 | 10/2010 |
| WO | 2012/144952 | A1 | 10/2012 |
| WO | 2013/159187 | A1 | 10/2013 |

OTHER PUBLICATIONS

Jan. 13, 2017—International Search Report and Written Opinion of PCT/NL2016/050322.
Oct. 25, 2018—(SG) Written Opinion—App. 11201709098S.
Jan. 27, 2016—(NL) Search Report—App. 2014765.
Oct. 1, 2016—(NL) Search Report—App. 2016059.

* cited by examiner

DRILLING INSTALLATION; HANDLING SYSTEM, METHOD FOR INDEPENDENT OPERATIONS

CROSS-REFERENCE TO RELATED APPLICATIONS

This application is a U.S. National Stage application under 35 U.S.C. § 371 of International Application PCT/NL2016/050322 (published as WO 2016/178576 A2), filed May 4, 2016 which claims the benefit of priority to Application NL 2014765, filed May 4, 2015 and to Application NL 2016059, filed Jan. 5, 2016. Benefit of the filing date of each of these prior applications is hereby claimed. Each of these prior applications is hereby incorporated by reference in its entirety.

The invention relates to a drilling installation.

Drilling installations are known for drilling of water, oil and/or gas wells on onshore or offshore locations. A drilling installations can be a mobile installation, for example a mobile offshore jack-up, or a can be a mobile installation mounted on a truck. A drilling installation can also be of a more permanent character, e.g. a permanent land based structure, or a permanent marine-based structure, such as a drilling platform. Offshore drilling installations may commonly be referred to as drilling rigs. The terms drilling installation and drilling rig may thus be used interchangeable.

A drilling installation typically comprises a drilling floor. The drilling floor is the floor of the drilling installation where the activities take place during the drilling operations. The drilling floor is typically the level where handling and connecting of tubulars or drill strings for drilling takes place. The drilling floor comprises a hole through which drill strings travel downwards into the earth bottom. Above the drilling floor a derrick may be positioned from which the drill strings may hang off to be lowered through the hole in the drilling floor towards the earth. The drill strings may be pipes of a certain length which are to be assembled to form a continuous drill pipe that can be inserted into the earth bottom. The drill strings are assembled at the drilling floor. There is a lot of activities as well as equipment on the drilling floor, in particular during drilling operations. It is a hazardous area as there is being worked with heavy equipment, with drilling fluids and above an oil or gas well. The drilling floor is generally known as one of the most dangerous areas for workers on the drilling installation.

The use of a drilling installation is rather expensive, so during development of an oil or gas field, there is an aim of drilling the right wells the first time. Later, during servicing of the wells, there is an aim of performing the servicing in a limited time.

During development of an oil or gas field, multiple wells are drilled from a single location. The wells are then fanning out to spread over the oil and/or gas reservoir. In case of an offshore reservoir, the well heads can be brought together above the water level, typically at fixed permanent constructions such as a jacket 18 as shown in FIG. 1.

During the productive life of the wells, the wells are being serviced. This is also known as 'well intervention operations'. Well intervention operations are carried out for example to ensure or prolong the production of the well. Well intervention operations are considered to be any operation that alters the state of the well and/or the well geometry, that may provide well diagnostics and/or that manages the production of the well. Well intervention operations are carried out with or on a drilling installation. Well intervention operations with the drilling installation or well intervention equipment are typically done on the drilling floor. Thereto, the drilling operation itself is interrupted, which is costly and time consuming. Then, the well intervention operation such as wireline operations or coiled tubing operations or braided line operations or slickline operations are performed from the drilling floor through the hole in the drilling floor to the respective well. This implies that the equipment for the well intervention operations is placed on the drilling floor itself, which may result in increased risks for the workers on the drilling floor. Also work-over operations on a well may be performed to service or maintain the well.

Well intervention operations are carried out after a well went into production and preferably during the production of the well. Temporary shutting down of the well is a complex, hazardous and expensive operation and is therefore not preferred. Well intervention operations may require equipment for performing operations such as coiled tubing, cleaning, recovering, drilling, wire line operations, monitoring, phishing etc.

Also when a well is depleted, the abandonment thereof is being carried out with a drilling installation.

Due to the high cost rate of a drilling installation as well as the hazardous operations on the drilling floor, there is an ongoing challenge in increasing the operational efficiency of the drilling installation and providing for a relative safe working environment.

There is a need for a drilling installation that obviates at least one of the above mentioned drawbacks.

Thereto, the invention provides for a drilling installation comprising a drilling floor for performing drilling operations, wherein the drilling floor is on a cantilever extendible outside of the drilling installation; further comprising an independent operations handling system arranged for handling equipment underneath the cantilever independent of the drilling operations on the drilling floor; wherein the independent operations handling system comprises a handling element for cooperation with the equipment to be handled; wherein the handling element is movable underneath the cantilever; wherein the handling system is mounted to a side of the cantilever.

By providing an additional handling system underneath the cantilever, simultaneous operations can be performed during drilling operations or sequential operations without interruptions. For example, during drilling operations on one well, there may be well intervention operations, such as coiled tubing or wireline operations, on another well. This is contrary to the prior art well intervention operations, wherein the coiled tubing is done via the same moonpool through which the drilling operations are performed. Consequently, the drilling operations need to be interrupted when coiled tubing is to be done, also when the coiled tubing equipment is not located on the drilling floor.

The additional handling system is mountable to the cantilever, and, as such, is retractable together with the cantilever.

By providing the handling system connected to the cantilever, a compact system can be obtained. When retracting the cantilever to a retracted position above the platform, the handling system is retracted together as well. So, no or minimal structural modifications to the platform have to be done and in retracted position of the cantilever, the additional handling system does not extend outside of the platform and is retracted together with the cantilever.

By providing the possibility for simultaneous operations during drilling, the efficiency in use of the drilling installation may be increased and more and/or more complex operations may be performed on the wells during a limited time frame with the drilling installation. During operations, the cantilever reaches out at least partly over the jacket with the well bay of multiple wellheads. By providing the additional handling system, material handling on the jacket (well bay), which is below the cantilever, or between the jacket and the main deck of the drilling installation can be done more easy, reducing handshakes from one crane to another crane and therefore the amount of main deck crane operations, which may increase safety. Additionally, blind crane operations, in which the crane operator has no visual contact with the hoisted load, can be reduced and/or can become redundant, also increasing safety. Moreover, the main deck crane activity can be disconnected from cantilever skidding operations.

Also, by providing the additional handling system, well intervention operations, work over operations or other operations may be performed underneath the cantilever without interfering with the equipment on the drilling floor. These operations can thus be performed independent of the drilling operations, and may be performed simultaneous or not simultaneous to the drilling operations.

In an embodiment, the handling system can be mounted at a distance below the drilling floor, to the cantilever, as not to interfere with the drilling operations on the drilling floor and to optimally be able to perform simultaneous operations.

Further, by providing the handling system at the side of the cantilever, there is no additional use made of the drilling floor. The equipment for the well intervention operations may be positioned and handled underneath the drilling floor.

Preferably, the handling system is mounted to a lateral side, e.g. the port side or starboard side, of the cantilever. By providing the handling system to the lateral side of the cantilever, the reach, or extension of the cantilever outside of the drilling installation, can remain unchanged, while simultaneous operations become possible due to the handling element that is movable underneath the cantilever. Also, by providing the handling system at the lateral side of the cantilever, limited additional space is used and the handling system becomes easily accessible when the cantilever is retracted above the main deck of the drilling installation. Alternatively, the handling system can be mounted to the aft side of the cantilever. This may be advantageous in situations with e.g. large jackets In an embodiment, the handling system can be mounted at a fixed position at the lateral side of the cantilever. In another embodiment, the handling system can be mounted translatable with respect to the cantilever, for example, the handling system can be mounted on horizontal rails or tracks and may then be skidded forward and backward along the rails. This may enable a larger reach for the handling system underneath of the cantilever. Also, it may allow the handling system to be used for additional material handling between the jacket with the well bay and the main deck.

Advantageously the handling system is provided with a handling element. The handling element is arranged for handling the equipment for the simultaneous operations. The handling element may be arranged for guiding independent operations equipment such as a wireline or a coiled tubing, and/or may be arranged for holding equipment such as a well intervention stack, a blowout-preventer or a X-mas tree.

By providing the handling element movable underneath the cantilever, the handling system may be accommodated in the relatively limited space underneath the drilling floor. In an embodiment, the handling element may be movable in a XY-plane underneath the cantilever. The handling system may for example be provided as a carriage running over rails underneath the drilling floor, or may for example be provided as a beam extending horizontally underneath the cantilever. Many embodiments are possible. Preferably, part of the handling system on which the handling element is provided is movable in a XY-plane, for example by means of an extendible arm, or a skiddable carriage, or hinge arm etc. The handling system is at one end connected to the cantilever and at another, free end, the handling element is provided. The XY-plane is considered to be a plane below the cantilever approximately parallel to the bottom side of the cantilever. In normal use circumstances, the XY-plane may be approximately horizontally. The handling element is preferably movable in the XY-plane as to allow for a relatively large reach with a limited vertical height of the system. The movement in the XY-plane may be translational movement, rotational movement and/or a combination thereof. The handling system may be mounted to a side of the cantilever, or a recess may be provided at a side or bottom of the cantilever to receive the handling system. Many variants are possible.

By providing the handling element movable underneath the cantilever, the handling element can be used for performing simultaneous operations during drilling operations without interfering to the operations on the drilling floor, as well as in the limited free space available between the jacket and the cantilever. Advantageously, the handling element is provided at a free end of a horizontally extendible arm, of which the opposite end can be connected to the cantilever. To provide for the movement underneath the cantilever, the arm can be movable in a XY-plane, and can for example be embodied as a segmented boom, or as a telescopic boom, etc, which is advantageous in view of the limited space available.

In an embodiment, the handling system comprises a support structure, wherein the support structure is configured for mounting to the cantilever. Further, the handling system may comprise a connection arm connectable to the support structure. The connection arm can be fixedly connected to the support structure and/or can be vertically adjustable with respect to the support structure and/or can be removable connectable to the support structure. At a lower end of the connection arm, a horizontally extendible arm may be provided that contains the handling element at a free end thereof. The horizontally extendible arm can be embodied as a segmented beam, or as a telescopically extendible arm, etc. The horizontally extendible arm is typically connectable to the connection arm via a slewing gear, however also other hinged connections or joints are possible. Advantageously, the horizontally extendible arm, is pivotable 360 degrees around the lower end of the connection arm. The connection arm can also be referred to as 'pedestal'. By providing this 360 degrees of action radius to the horizontally extendible arm, the operational reach of the arm can be relatively large, and as such optimal use may be made of the simultaneous operations possibility.

In a preferred embodiment, the handling element is vertically adjustable with respect to the cantilever. More preferably, the connection arm can be vertically adjustable with respect to the support structure of the handling system. In an alternative embodiment, the horizontally extendible arm can be vertically adjustable with respect to the connection arm and/or to the support structure. By providing the handling system vertically adjustable, the handling element can be lowered for example for lowering equipment, such as a stack or a X-mas tree. When retracting the cantilever, the handling element and the arm to which it is mounted can be adjusted upwardly such that the handling element can become in a position aside of the cantilever, for example for storage during non-use. Also, during retracting the cantilever, the handling system may be used to take additional equipment with, e.g. a container. As such, additional deck crane operations may be reduced, which may save time. Due to the vertical adjustability of the handling system, the handling element with the equipment can be moved upwardly before or during retracting of the cantilever such that the equipment may become clear from obstacles, such as aft skid rail of the cantilever, and can remain above the main deck during retracting. Once the cantilever is in retracted position, the handling element with equipment can be lowered until the equipment can reach the main deck and can be decoupled from the handling element.

Advantageously, due to the vertically adjustment of the handling system, material or equipment handling between the jacket and the main deck by means of the handling system may become possible without interruption of the drilling operations and/or retracting of the cantilever. By using the handling system for independent operations equipment handling between the jacket and the main deck, less main deck crane operations may become required, which enhances safety. When the handling element reaches underneath the cantilever, it can be lowered to the jacket, e.g. to pick up a load. Then, the handling element can be moved, typically horizontally, to the side of the cantilever. When the handling element is aside of the cantilever, it can be vertically adjusted in height to a position in which it, including the load, can be above main deck and obstacles. Then, the handling element can be moved, advantageously horizontally, towards the main deck, to lower the load onto the main deck. Preferably, the position of the handling system on the lateral side of the cantilever is determined to allow optimal reach of the jacket and reach onto the main deck.

The handling element can be vertically adjustable by vertically adjusting the handling system and/or by providing for hoisting means onto the handling system allowing to vertically move the handling element. Vertical adjustment of the connection arm, or pedestal, with respect to the support structure and the cantilever can be done in various ways. Preferably, the vertical adjustment is provided by means of a rack-and-pinion system. Alternatively, the handling element and/or the horizontally extendible arm and/or at least one segment of a segmented boom may be pivotable upwardly, e.g. around horizontal axis-hinges by means of actuators, when the arm and/or handling element is alongside of the cantilever. Alternatively, hoisting lines can be provided that hoist the horizontal arm and/or handling element up and/or down.

In a preferred embodiment, the handling element may comprise a first handling part for handling first equipment, such as a wireline, and may comprise a second handling part for handling second equipment, such as a wireline stack or a X-mas tree etc. Advantageously, the handling element is dedicated for a determined operation. For example, for a wireline operation, a sheave as a first handling part may be provided for handling the wireline and a hoist hook or block as a second handling part may be provided for holding the wireline stack. In another embodiment, a clamping block as handling element may be provided to hold e.g. well intervention stack or a X-mas tree. In a further embodiment, there may be provided for a dedicated handling tool for coiled tubing, as coiled tubing typically requires larger load capacity than wireline operations.

The handling system may also be provided with two or more handling elements for different dedicated operations.

In an advantageous embodiment, by providing a first handling part to hold the wireline and a second handling part to hold the wireline stack (wireline rig-up), the wireline rig-up can be held under approximately constant tension during wireline operations. The second handling part can be a hoist element, having a hoist line tensioned on a hoist winch. This is advantageous, as such a wireline rig-up typically collapses under its own weight, so by tensioning it with a hoist line provided on the handling system, additional hoisting activity and use of additional equipment can be obviated. Advantageously, the rig-up second handling part is provided with a dual hoist line/cable and dual drum. The two hoist cables can be connected to an outer edge of a top side of the rig-up, each to an opposite side, then the first handling part, guiding the wireline, can be positioned between these cables, and as such, the wireline can be guided relatively easy to the center of an entrance of the wireline rig-up. This way, the wireline rig-up can be pulled up and held closely to the first handling part guiding the wireline, which saves space compared to normal wireline operations.

Advantageously, the wireline passes at least partly through the handling system. In an advantageous embodiment, the connection arm can be configured for receiving the wireline, such that the wireline can pass through the connection arm. Further, the wireline can pass along the horizontal arm towards the auxiliary handling element. By guiding the wireline through the connection arm, the forces on the wireline can be reduced compared to a wireline reel on the main deck pulling directly at the handling element. By guiding the wireline along the handling system, the wireline reel can be mounted for example on top of the cantilever or at the side of the cantilever.

The drilling installation or drilling rig may be a jack-up platform, a fixed offshore platform, a jack-up vessel or a semi-submersible platform, or a drilling vessel, etc. Many embodiments of a drilling installation are possible.

The drilling installation is provided with a cantilever that comprises the drilling floor. The cantilever typically is extendible outside of the drilling installation. A cantilever may be provided for example on a jack-up platform where it may be movable arranged above the deck floor of the jack-up platform. Also a jack-up vessel, semi-submersible drilling rig or any other drilling rig may be provided with a movable cantilever. The advantages of providing a cantilever on which the drilling floor and the derrick are provided are known in the art. For example, by providing a cantilever that is extendible outside of the drilling installation, well intervention operations or drilling operations can be performed over a jacket comprising the well heads.

In an embodiment, the independent operations handling system is provided at a distance below the drilling floor that is on the top side of the cantilever. Preferably, the independent operations handling system is provided at a lower part of the cantilever having the drilling floor at its top side, such that the horizontally movable handling element may be movable in the relatively limited space available underneath the cantilever. The handling system may be connected at a bottom side of the cantilever, or, preferably, the handling system may be connected at a lateral side of the cantilever, for example at an aft side or the starboard side or the port side, or the handling system may even be connected to one of the sides of the moon pool.

In an embodiment, the handling system may be disconnectable from or removable mounted to the cantilever, for storage and/or maintenance. For example, a carriage as handling element may be movable over rails mounted to the bottom side of the cantilever. In another example, a horizontally extendible beam, such as a telescopic beam or a knuckle beam, may be mounted to a lateral side, e.g. starboard side or port side or a moon pool side or an aft side, while the beam may be extendible underneath the cantilever to perform simultaneous operations on wells during drilling operations.

The handling element is embodied for cooperation with the equipment to be handled. The equipment may be for example a wireline or a coiled tubing. Cooperation is then merely guiding of the wireline or coiled tubing equipment to/from a reel. The handling element may then be embodied as a guide element, such as a banana sheave that may be adjustable or not. Advantageously, the reel on which the wireline or the coiled tubing is provided may be positioned on the deck of the drilling installation which is below the cantilever or on an additional foldable deck at a stern side of the deck of the drilling installation. In a preferred embodiment, the wireline can be guided at least partly through the handling system.

The handling element may also be embodied for cooperation with equipment to be handled underneath the drilling floor, such as a blowout preventer or a X-mas tree. To that end, the handling element may be embodied as a holding element such as a lifting hook or clamping device. Equipment such as a blowout preventer or a X-mas tree typically are lifted from the deck of the drilling installation to the well head deck of the jacket. Such a lifting operation may advantageously be performed simultaneously to the drilling operation, thus saving time and costs. In an embodiment, the handling system may thus be provided with a guide element as handling element or with a holding element as handling element or with both.

In an advantageous embodiment, the handling system and/or the handling element may be adjustable in a vertical direction, i.e. in a Z-direction transverse to the XY-plane. By providing a vertically adjustable handling element and/or handling system, the vertical position of the guide element for a wireline, or a coiled tubing or the vertical position the holding element for equipment to be handled, such as a blowout preventer, or a X-mas tree, may be adjusted. Then, the blowout preventer or the X-mas tree may be lowered towards the jacket comprising the well heads. Due to the vertical adjustment, hoisting capacity and/or lifting capacity may be provided by the handling system. Alternatively, hoisting capacity may be provided by a hoisting cable that is being guided over sheaves on or through the handling system. A winch may be provided on the handling system.

In an advantageous embodiment, the handing system is vertically adjustable between a first operational position, in which the handing element is movable underneath the cantilever, and a second operational position, in which the handling element is aside of the cantilever. In the first operational position, the handing element is movable underneath the cantilever and independent operations on the jacket or wells can for example be performed. In the second operational position, the handing element is aside of the cantilever, for example for handling equipment to/form the main deck, or for storage of the handing system, or for holding a container during retraction of the cantilever.

The invention also relates to a cantilever for mounting on a drilling installation, wherein the cantilever is provided with a handling system at a lower end thereof for handing equipment independent of drilling operations, wherein the handling system comprises a handing element that is arranged for movement underneath the cantilever.

The invention further relates to the handling system and to a method for performing independent operations underneath the drilling floor.

Further advantageous embodiments are represented in the subclaims.

The invention will further be elucidated on the basis of exemplary embodiments which are represented in a drawing. The exemplary embodiments are given by way of non-limitative illustration.

Figure 5A:
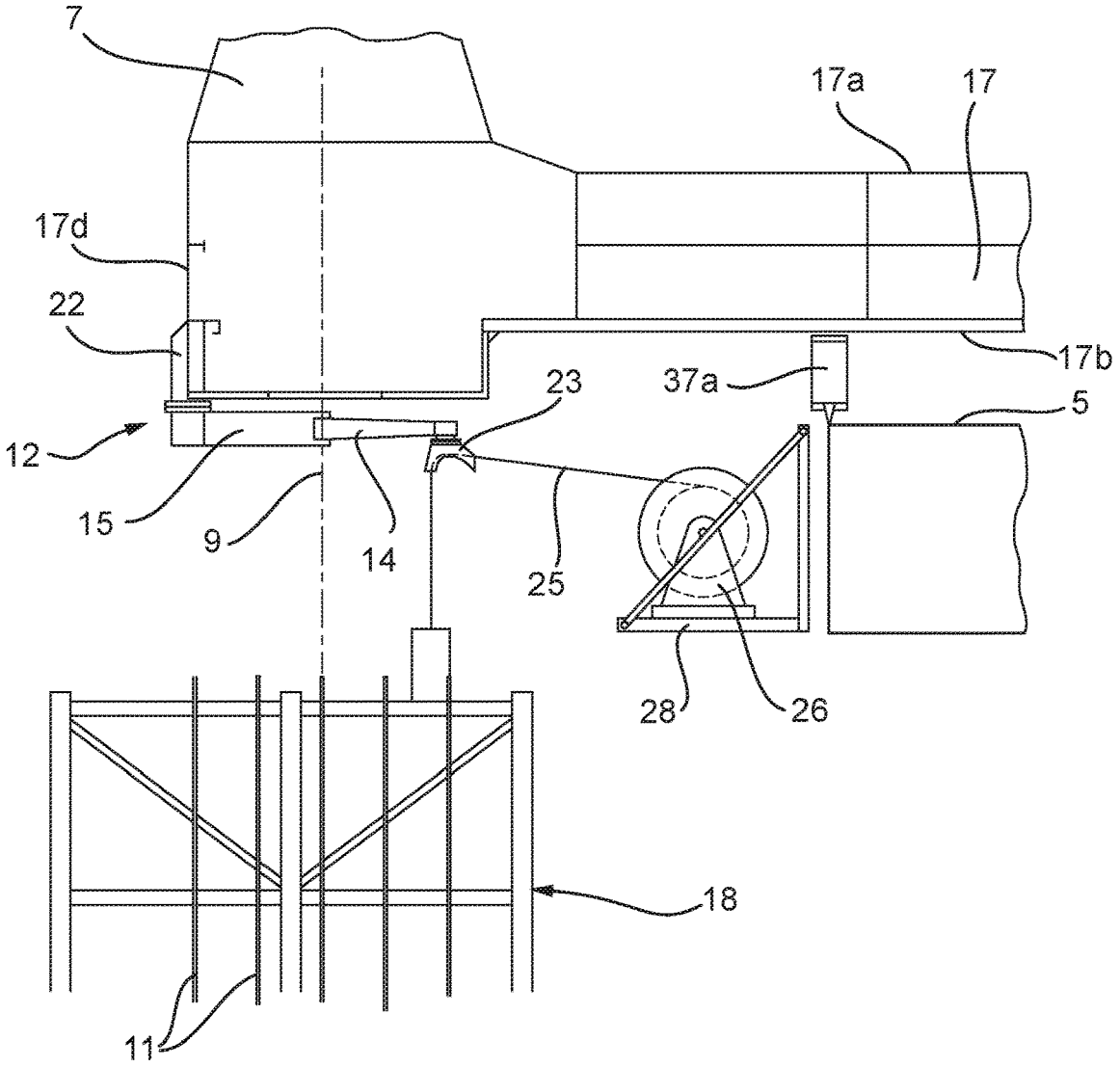
Figure 5B:
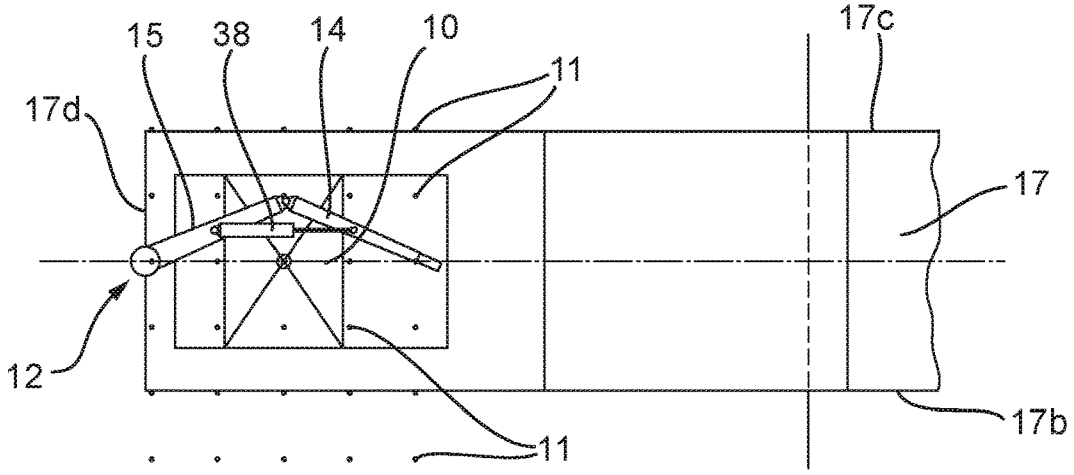

FIG. 5*a* shows a schematic side view of a cantilever reaching over a well platform and an embodiment of a handling system mounted to the aft side of the cantilever;

FIG. 5*b* shows a top view of FIG. 5*a;*

Figure 6A:
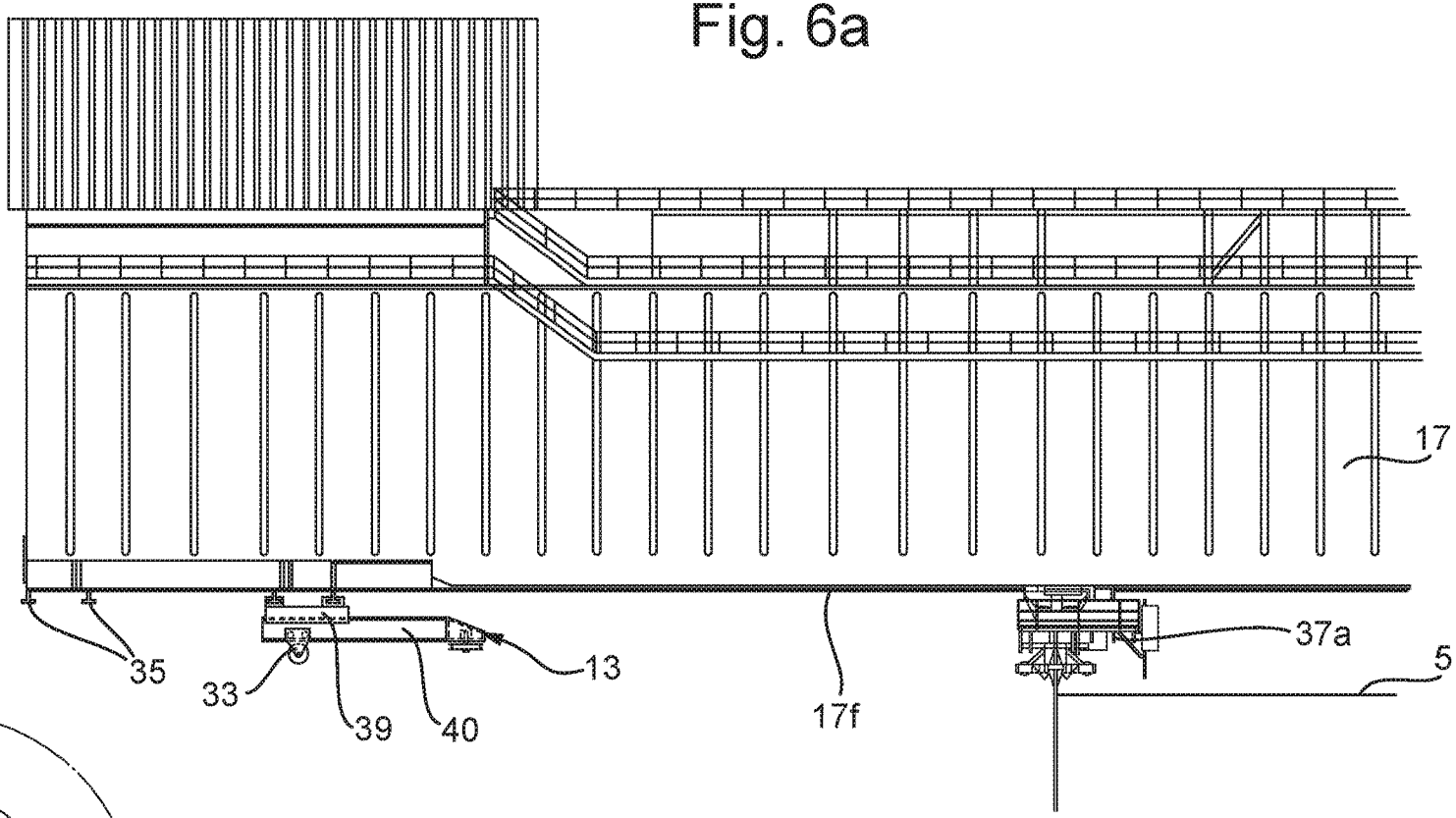
Figure 6B:
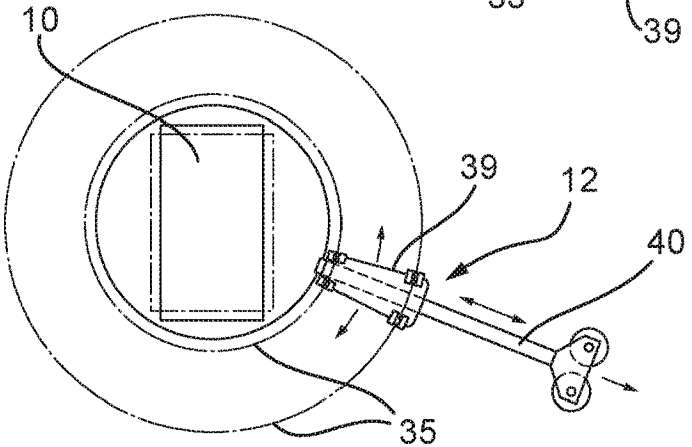

FIG. 6*a* shows a side view of an embodiment of a handling system mounted to a bottom side of the cantilever;

FIG. 6*b* shows a bottom view of the handling system of FIG. 6*a;*

Figure 7A:
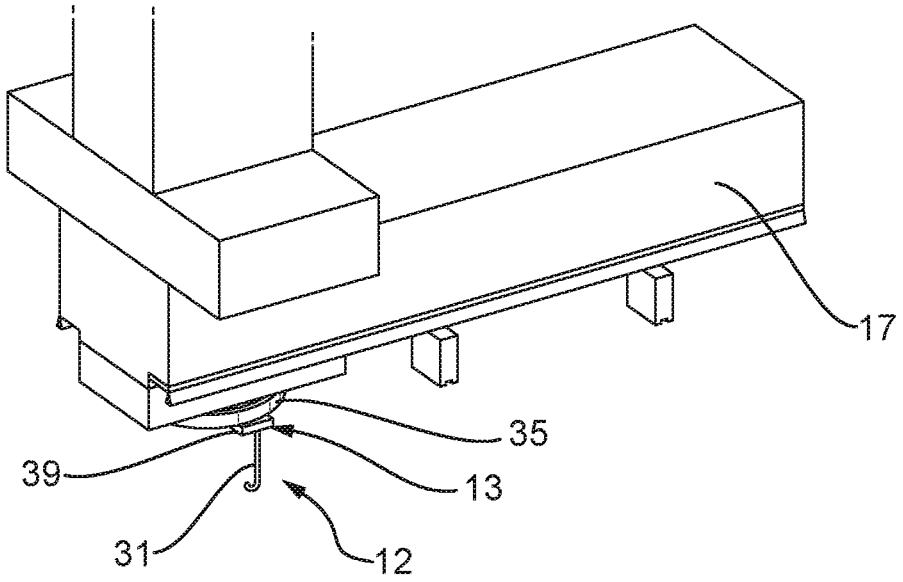
Figure 7B:
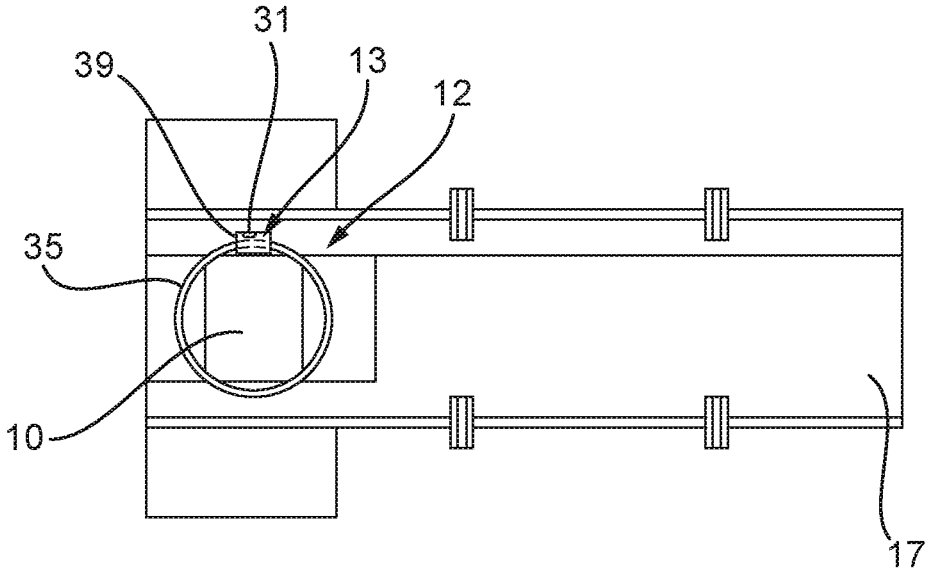

FIG. 7*a* shows a schematic perspective view of an embodiment of a handling system underneath the cantilever;

FIG. 7*b* shows a bottom view of the handling system of FIG. 7*a;*

Figure 8A:
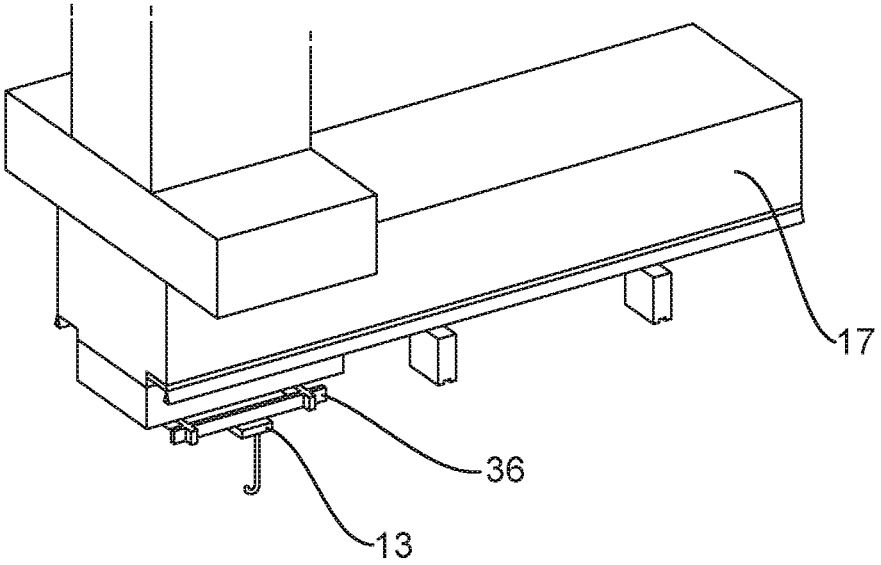
Figure 8B:
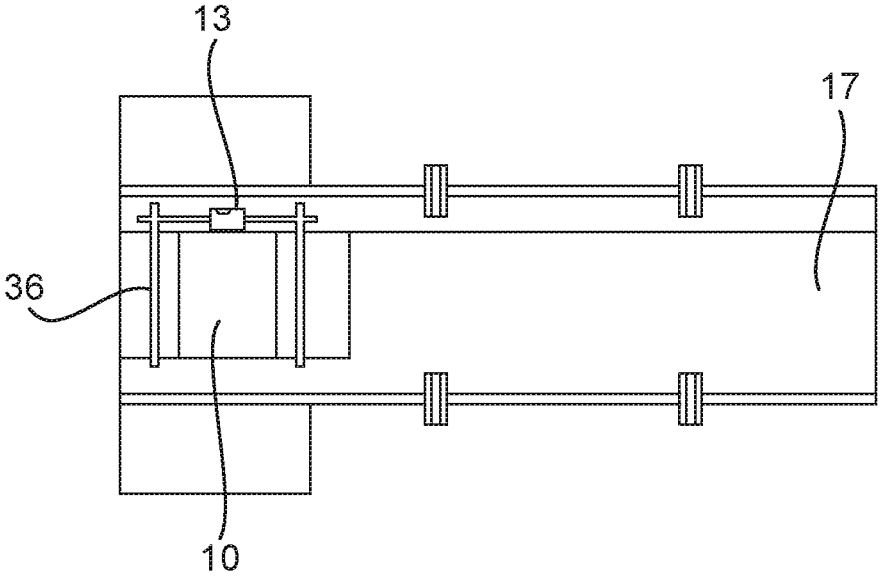

FIG. 8*a* shows a schematic perspective view of another embodiment of a handling system underneath the cantilever;

FIG. 8*b* shows a bottom view of the handling system of FIG. 8*a;*

Figure 9:
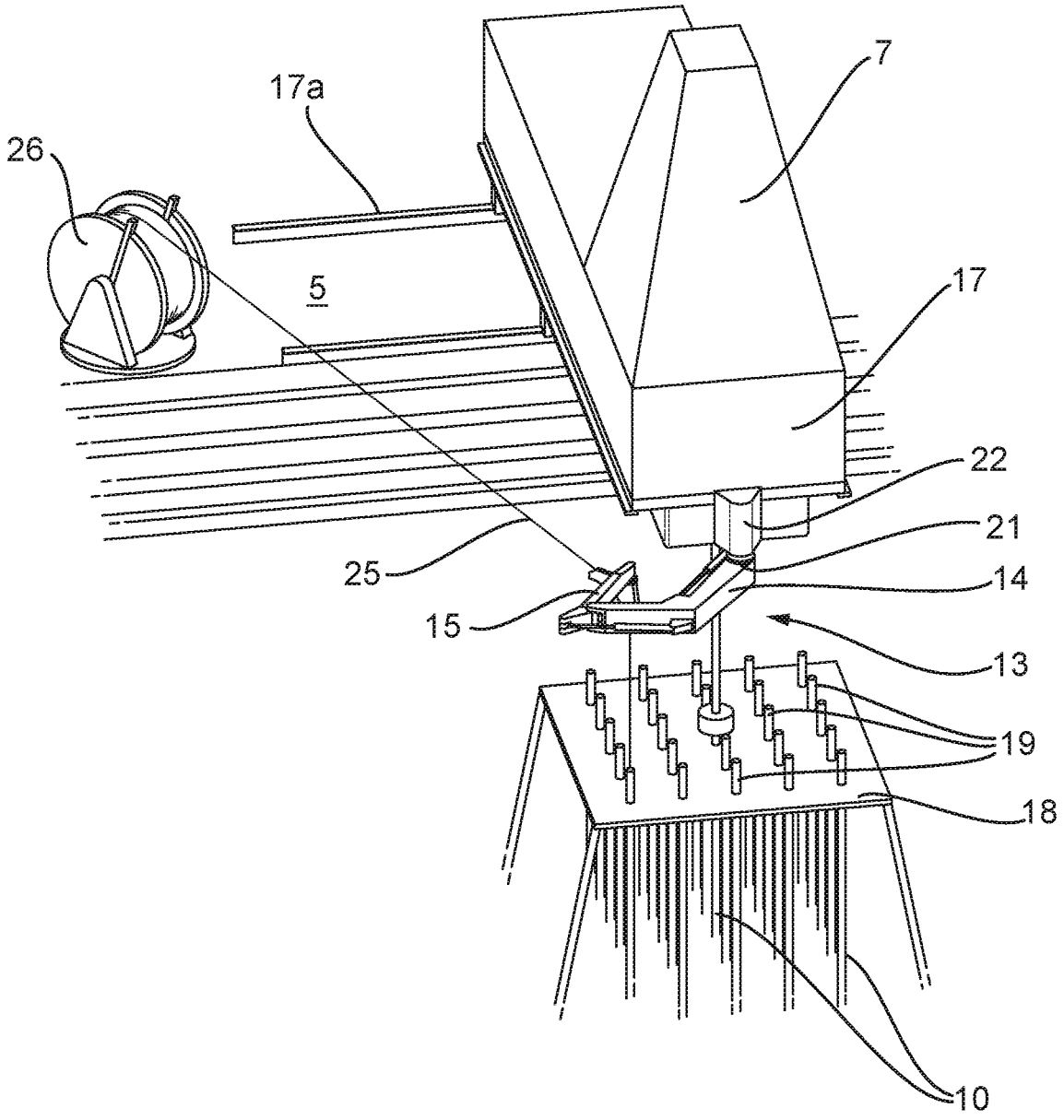
Figure 10:
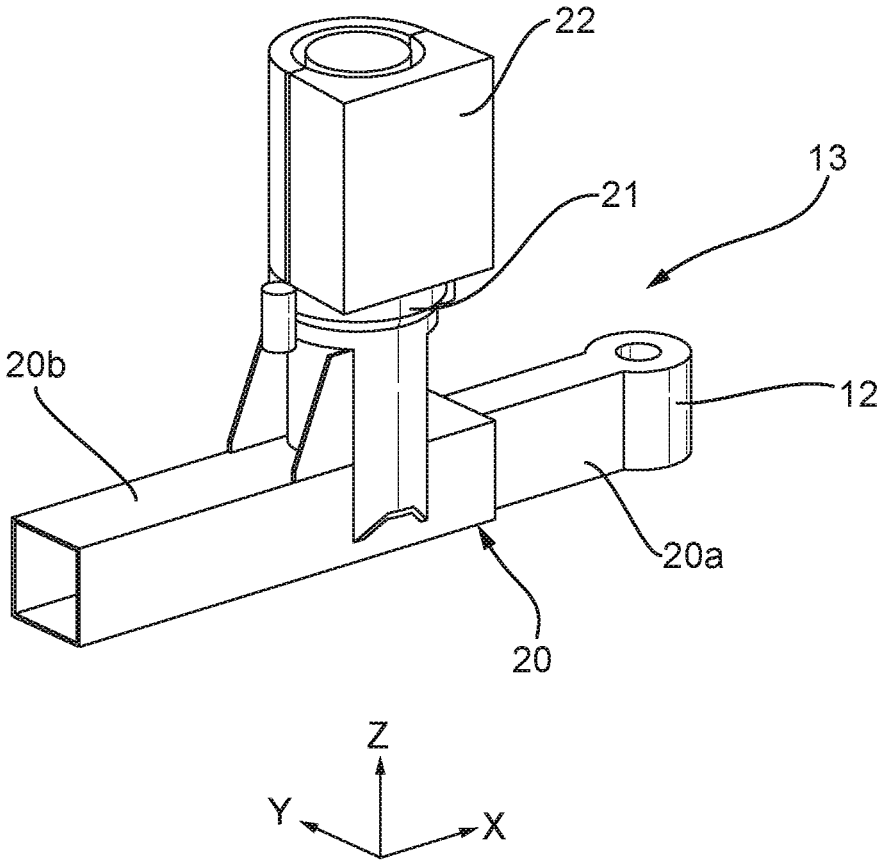
Figure 11:
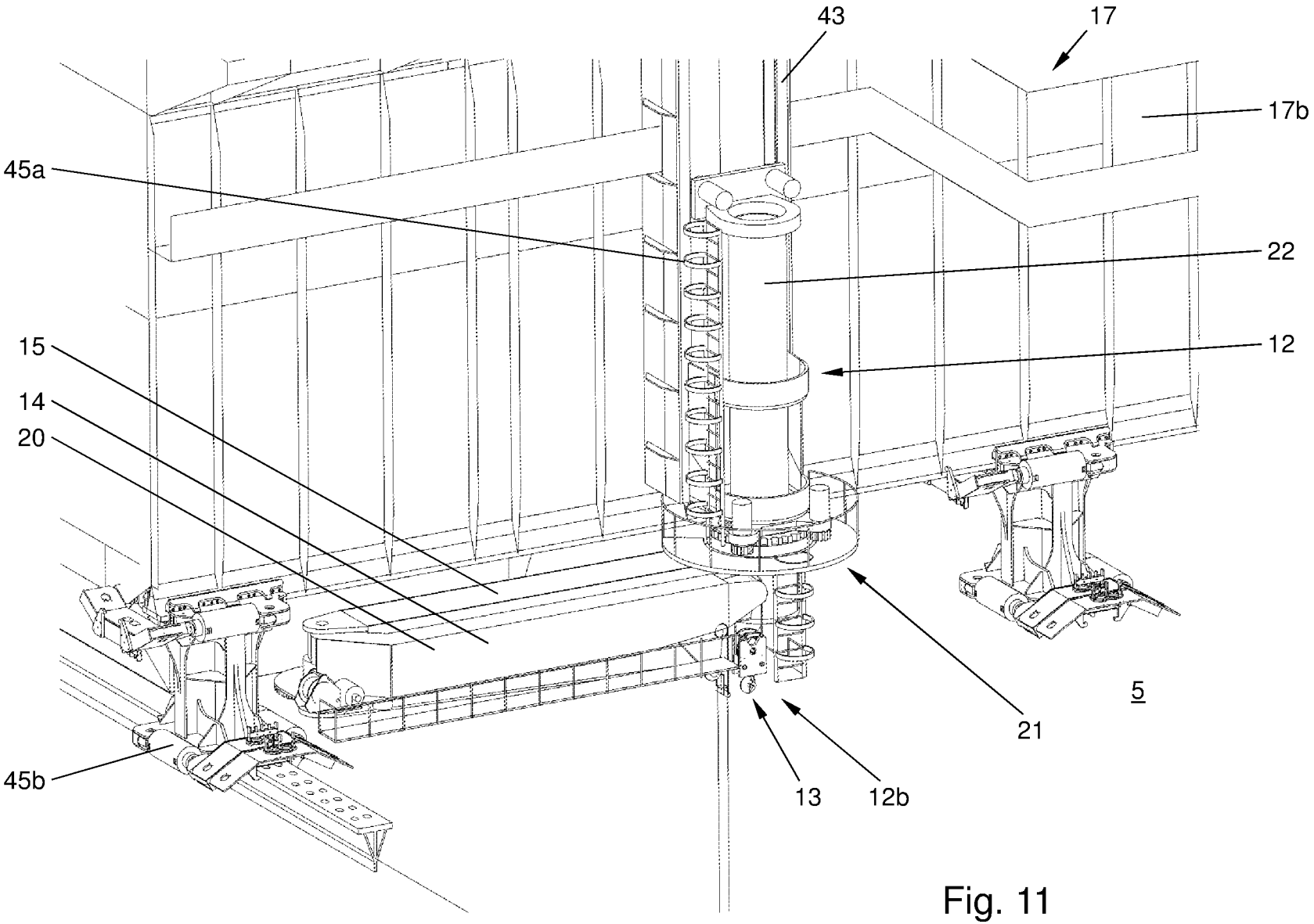
Figure 12:
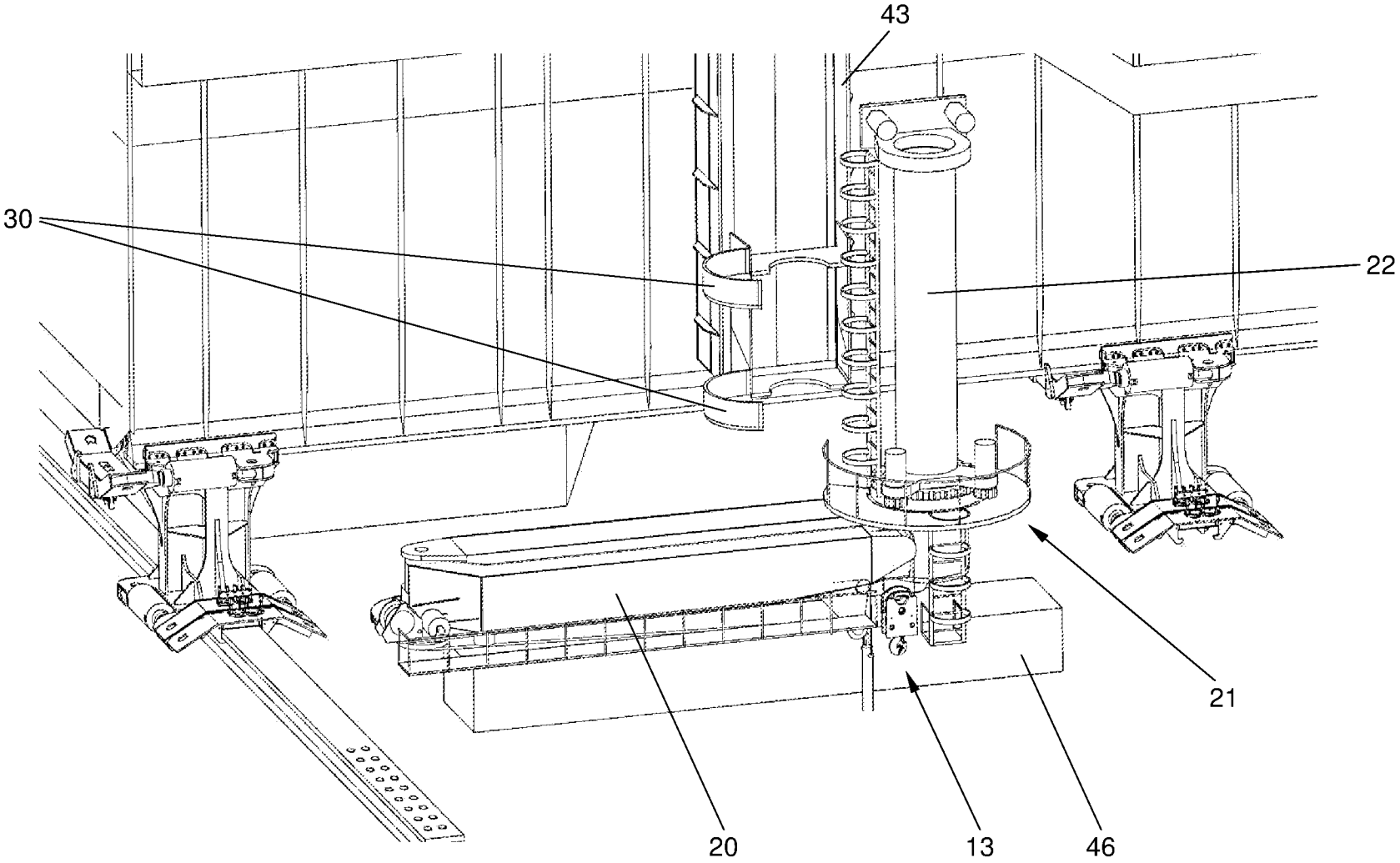
Figure 13A:
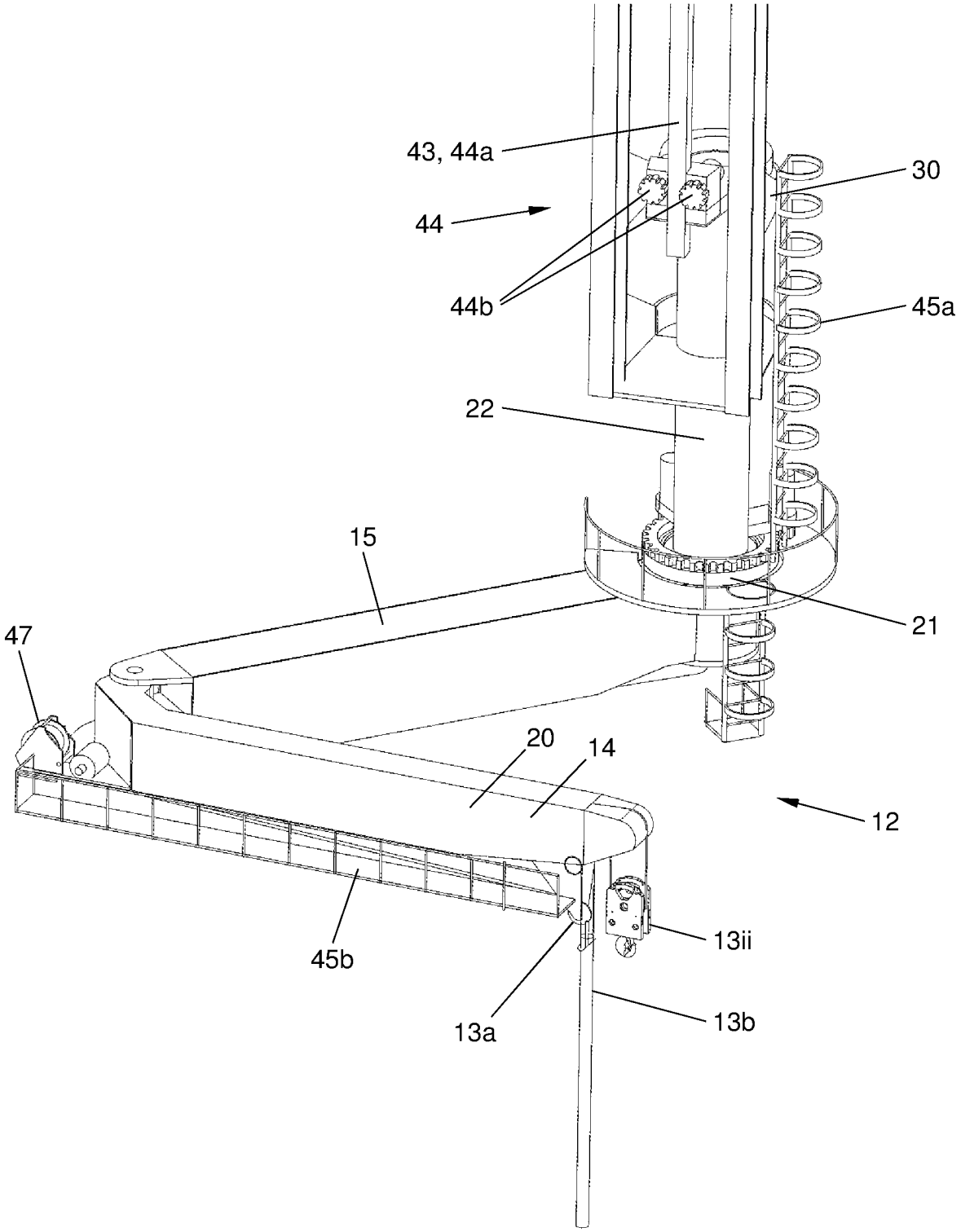
Figure 13B:
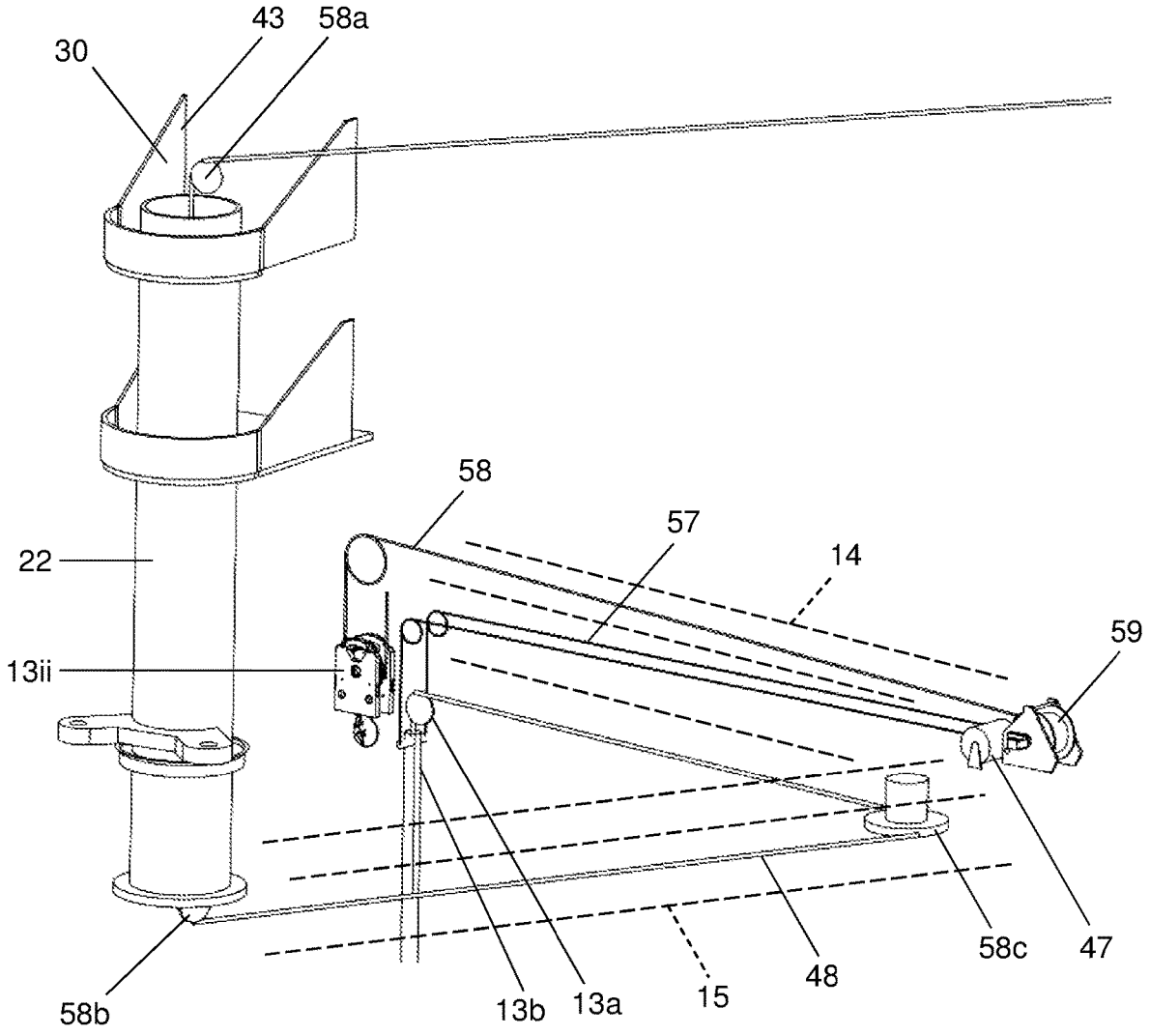

FIG. 9 shows a perspective schematic view of another embodiment of a handling system;

FIG. 10 shows an alternative embodiment of a handling system having a telescopic arm;

FIG. 11 shows an alternative embodiment of a handling system mounted to the lateral side of the cantilever;

FIG. 12 shows the handling system of FIG. 11 disconnected from the cantilever;

FIG. 13*a* shows an embodiment of the handling system with a rack-and-pinion vertical displacement mechanism;

FIG. 13*b* shows a detail of the embodiment of the handling element of FIG. 13*a;*

Figure 13C:
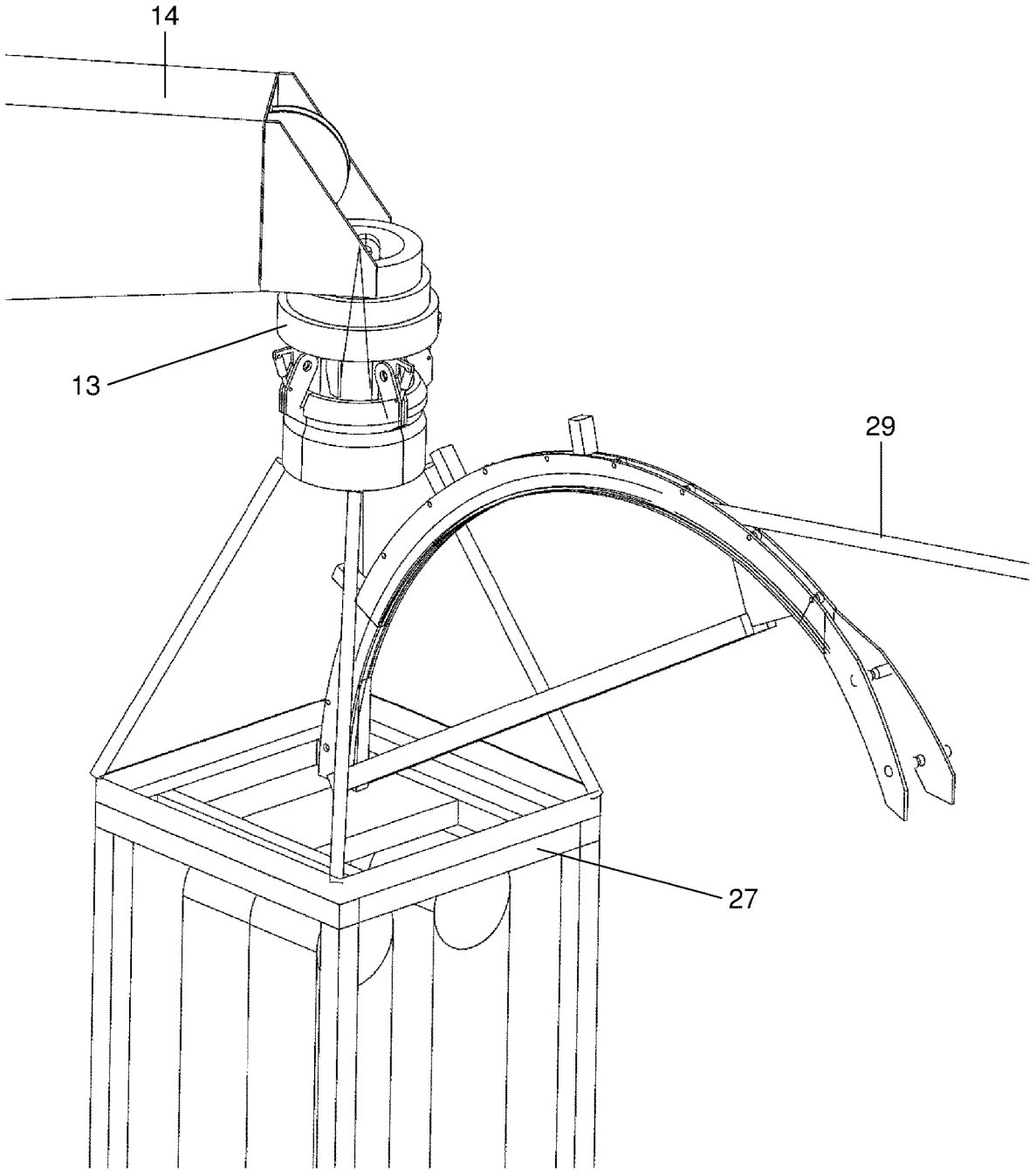
Figure 14:
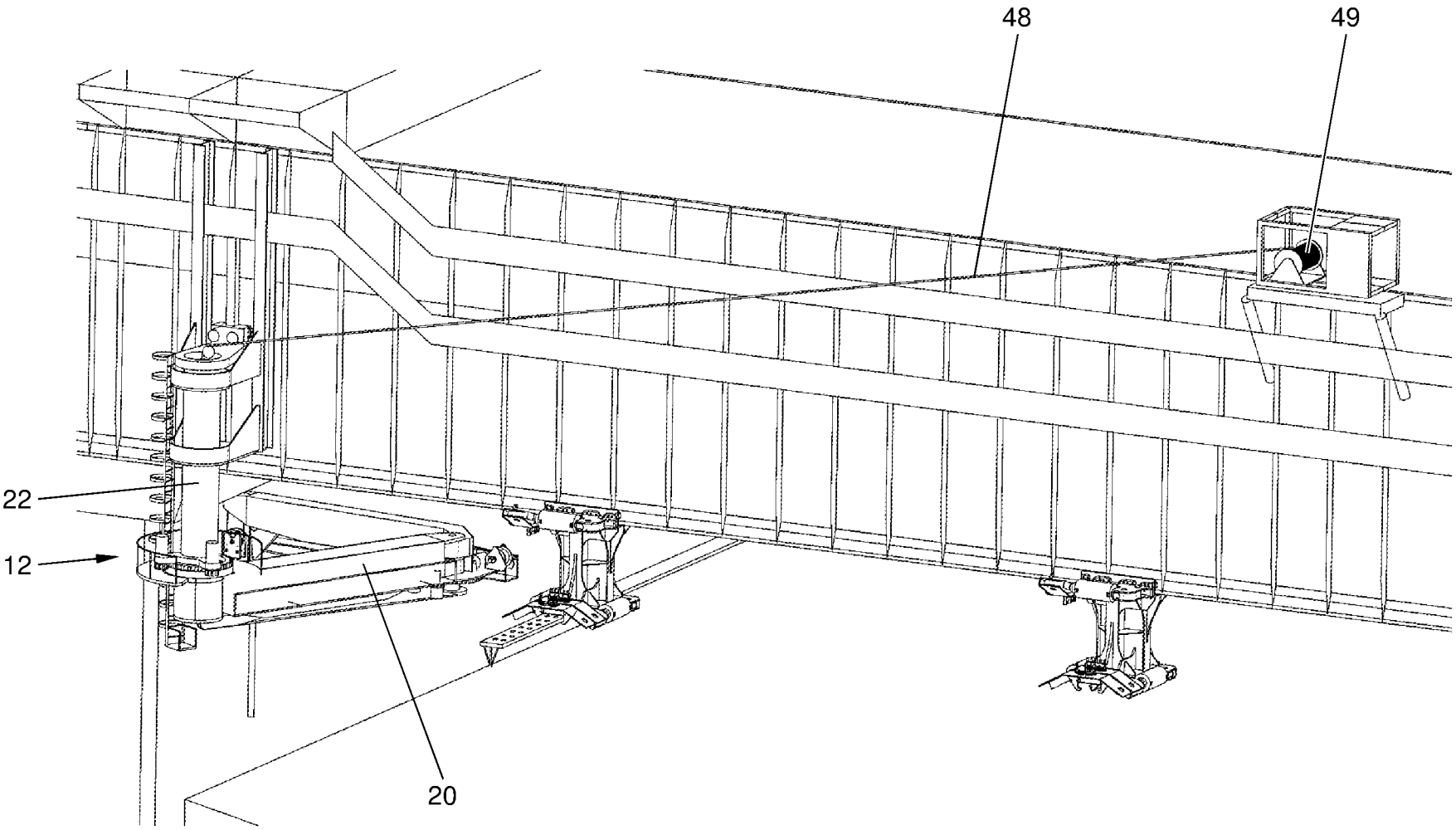
Figure 15A:
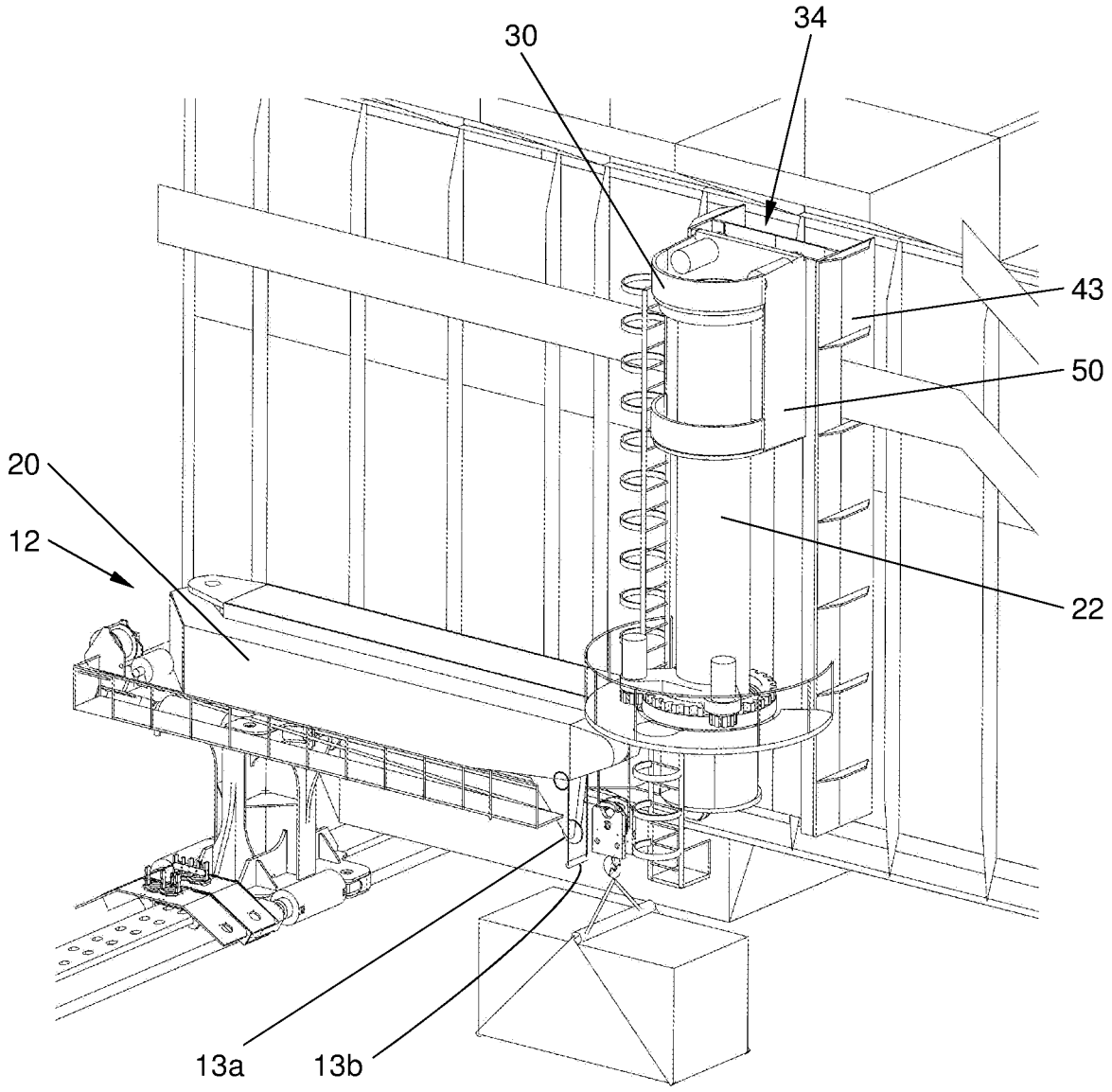
Figure 15B:
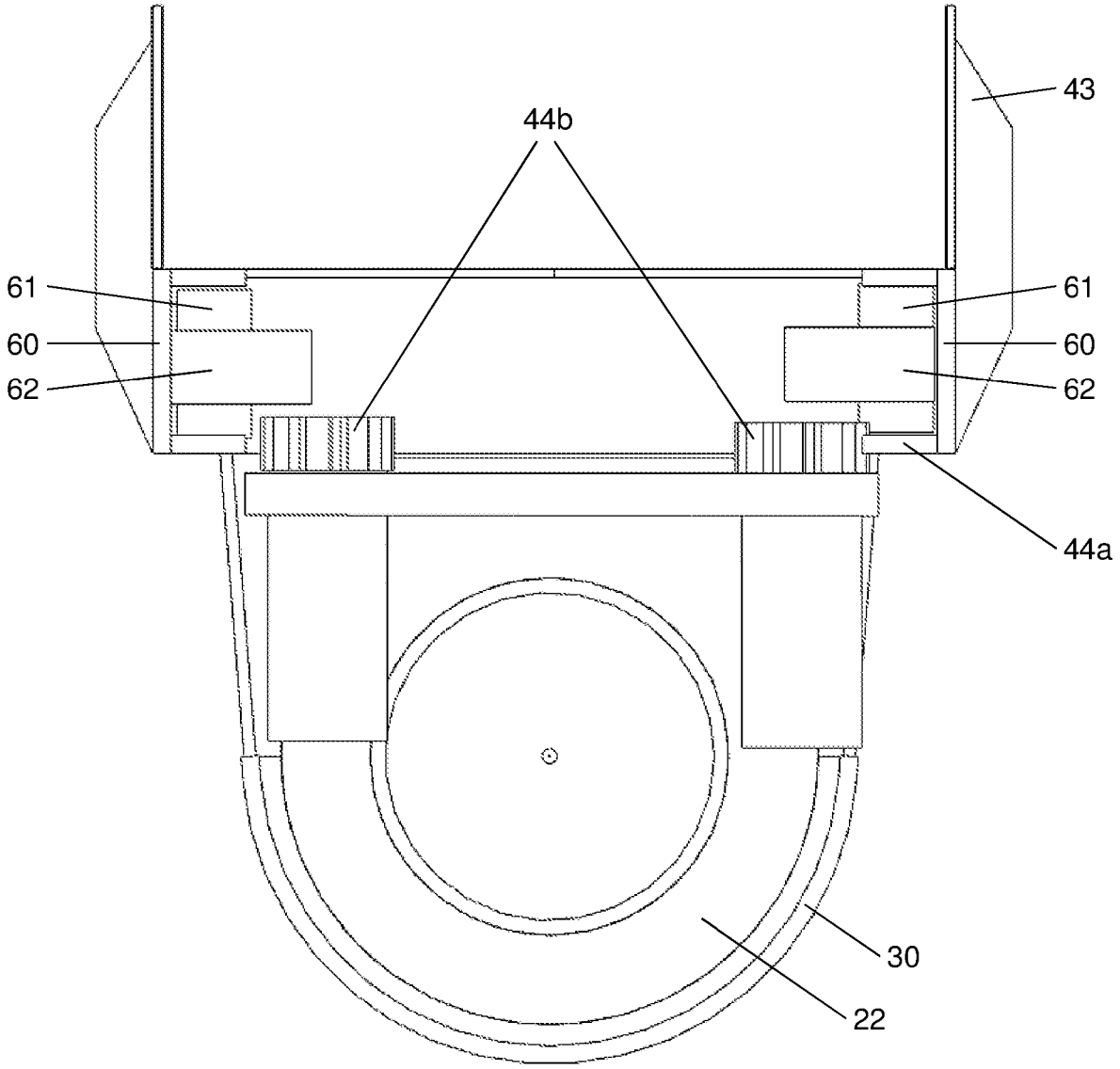

FIG. 13*c* shows another embodiment of a handling element;

FIG. 14 shows an embodiment of the handling system with a wireline guided through the handling system;

FIG. 15*a* shows an alternative embodiment of a handling system with a vertical displacement mechanism;

FIG. 15*b* shows a detail of the vertical displacement mechanism of FIG. 15*a;*

Figure 16A:
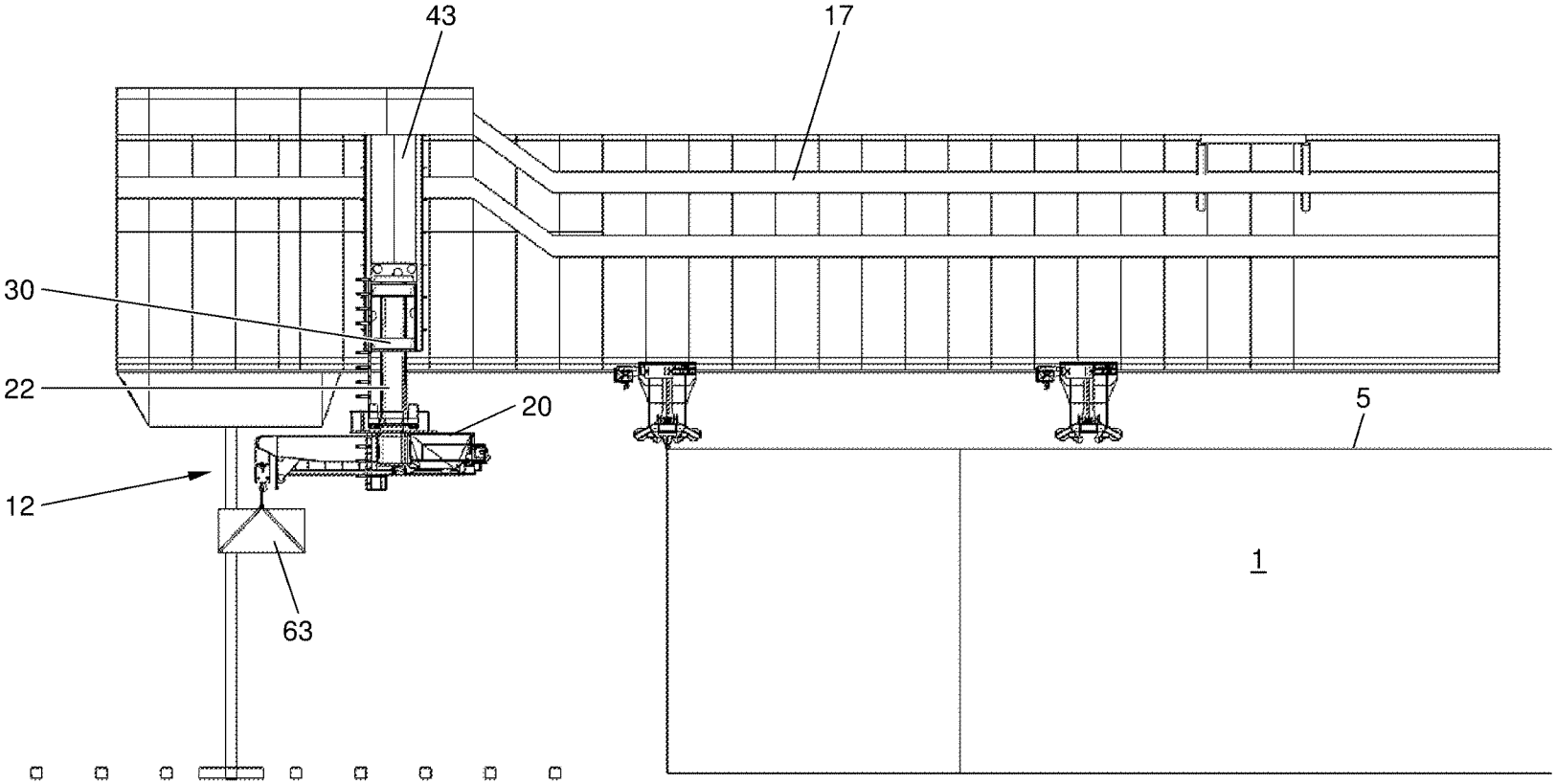
Figure 16B:
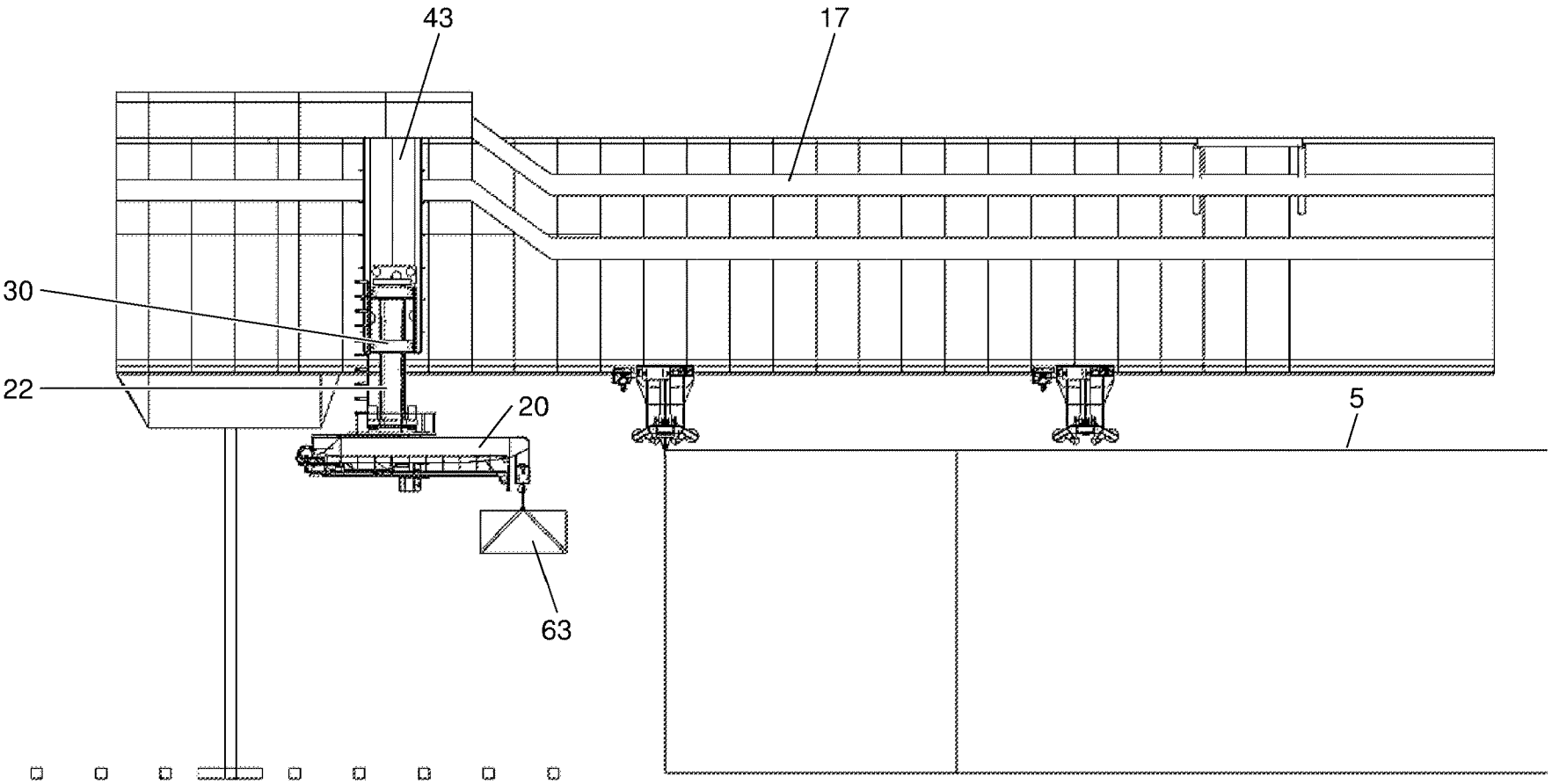
Figure 16C:
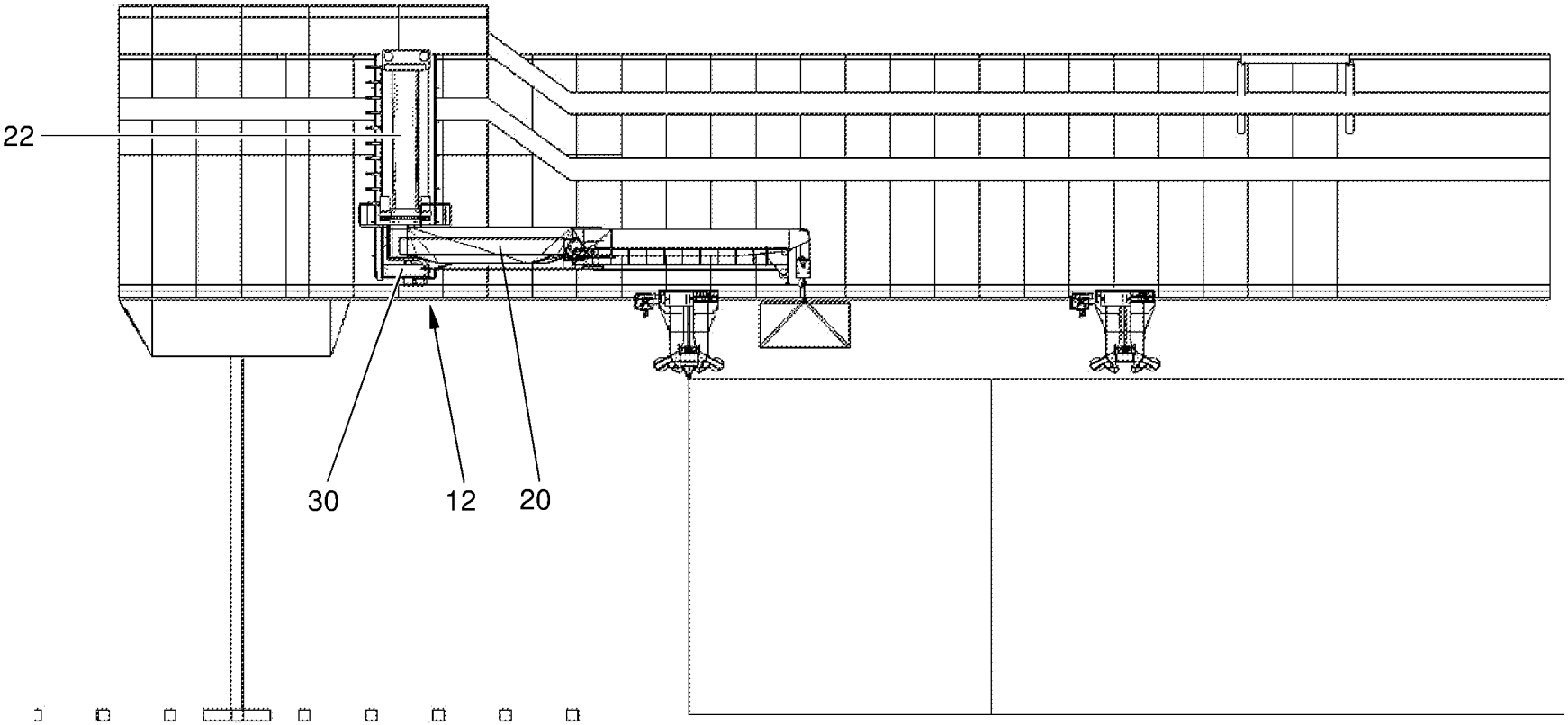
Figure 17:
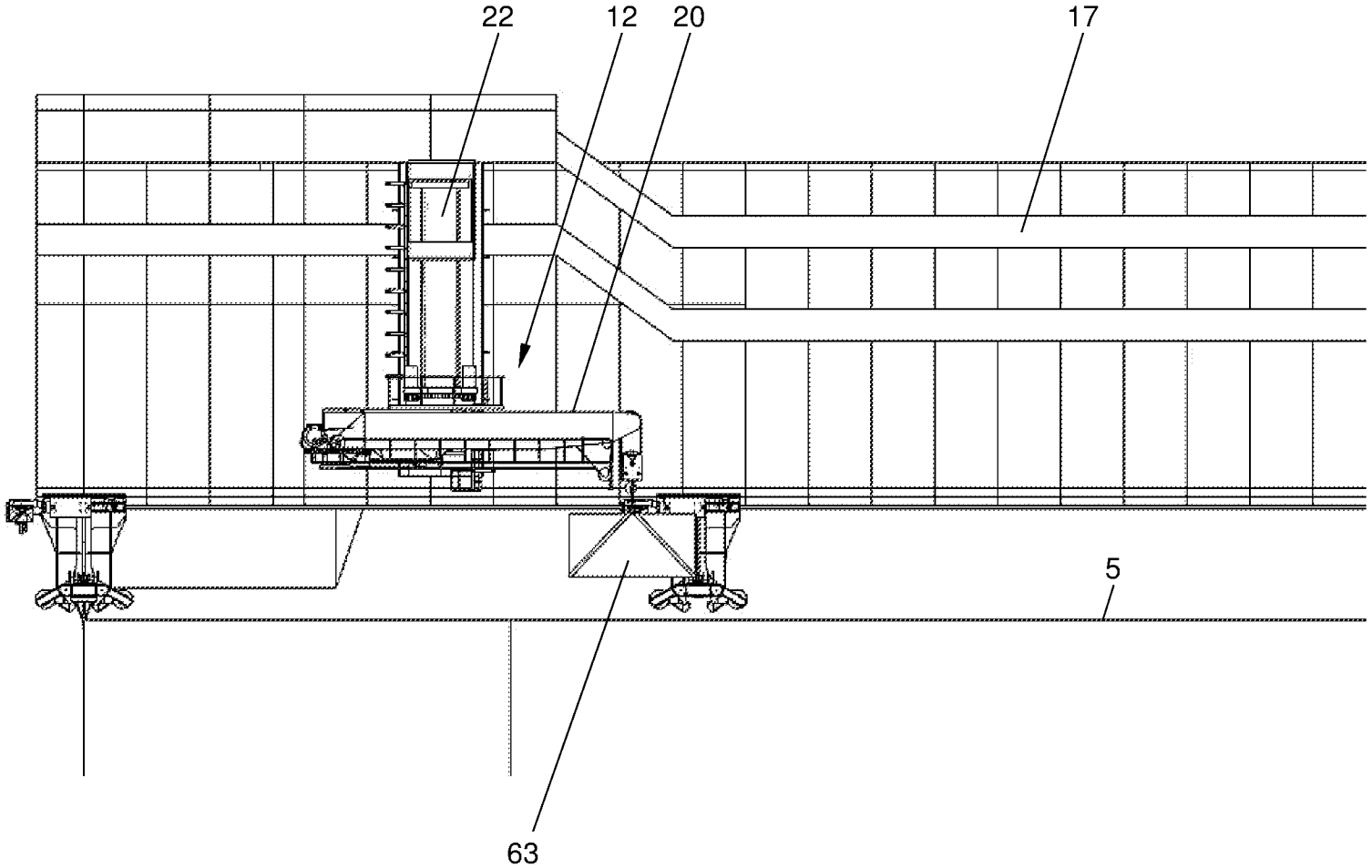

FIG. 16*a* shows a side view of a general arrangement of the handling system holding a load underneath the cantilever when the cantilever is extended;

FIG. 16*b* shows a side view of a general arrangement of the handling system of FIG. 16*a* with the handling system pivoted towards the drilling installation when the cantilever is extended;

FIG. 16*c* shows a side view of a general arrangement of the handling system of FIG. 16*a* and FIG. 16*b* with the handling system moved vertically up and extended such that the load is above the main deck when the cantilever is extended;

FIG. 17 shows a side view of a general arrangement of the handling system of FIG. 16*a* and FIG. 16*b* with the handling system moved vertically up during retracting of the cantilever.

It is noted that the figures are only schematic representations of embodiments of the invention that are given by way of non-limiting example. In the figures, the same or corresponding parts are designated with the same reference numerals.

Figure 1:
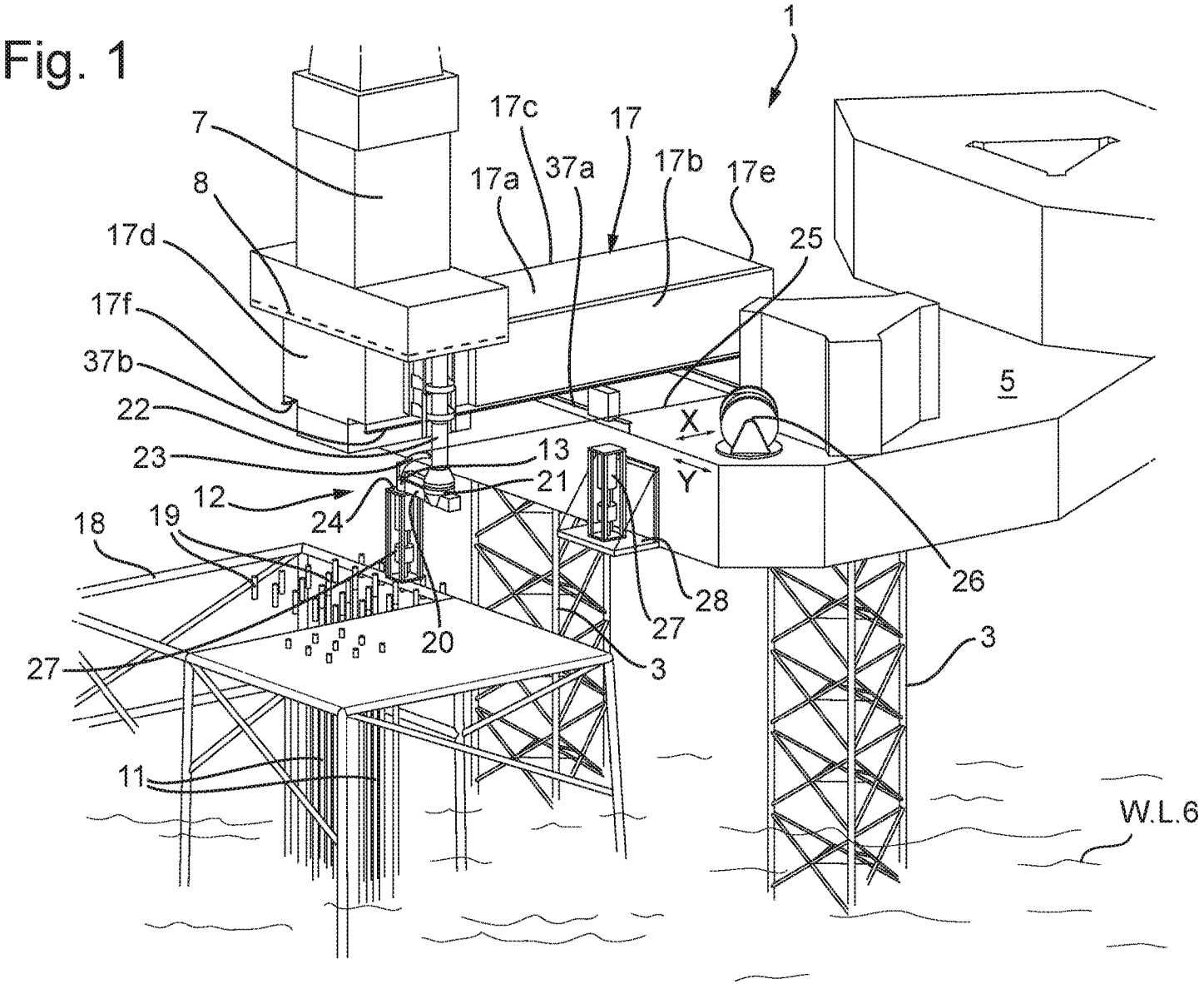
FIG. 1 shows a perspective view of a general arrangement of a drilling installation with a cantilever with a handing system mounted to the cantilever.

FIG. 1 shows a schematic perspective view of a drilling installation 1. The drilling installation 1 is here embodied as a jack-up platform. Such a drilling installation 1 is typically temporarily positioned at an offshore location where an oil and/or gas field is exploited next to a well platform 18. The drilling installation 1 may be used for drilling wells when the oil and/or gas field is being explored, and may be used for maintenance or servicing of the wells and/or for well intervention during the production life of the wells.

FIG. 1 shows a schematic perspective view of the drilling installation 1 comprising a cantilever 17. The derrick 7 is here positioned on top of the cantilever 17. The drilling floor 8 is positioned at an upper side 17*a* of the cantilever 17. The cantilever 17 further has lateral sides 17*b*, 17*c*, an aft side 17*d*, a front side 17*e* and a bottom side 17*f*.

Figure 2:
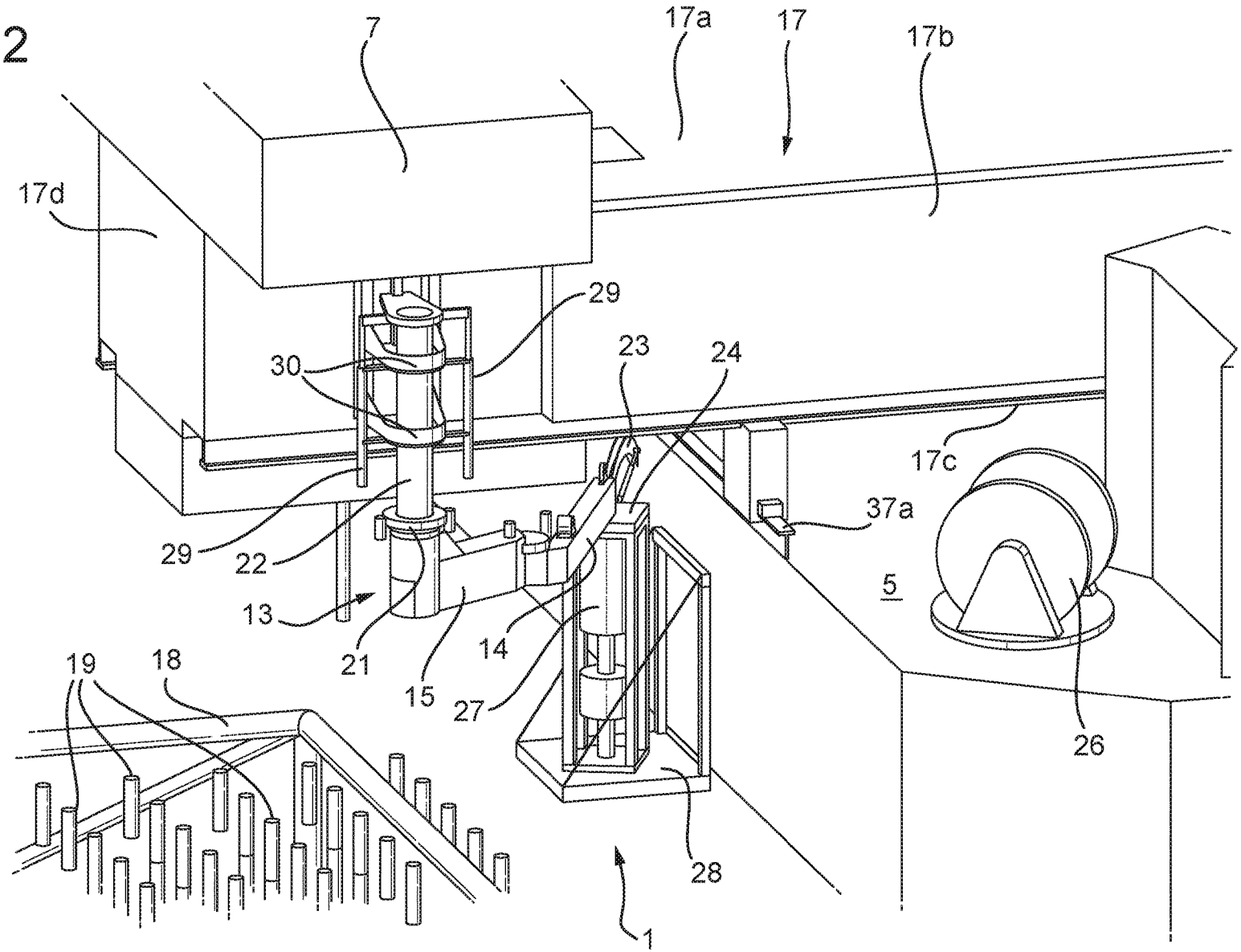
FIG. 2 shows an embodiment of the handing system mounted to a lateral side of the cantilever.

The moonpool 10, not visible in this figure, is provided as an opening through the cantilever 17 through which the drilling string may travel further downward towards the earth bottom. In this embodiment, the cantilever 17 is translatable with respect to the deck 5 of the drilling installation 1 in a X-direction and a Y-direction over skidding rails 37*a* and 37*b*. In alternative embodiments, the cantilever 17 may be rotatable with respect to the deck 5 or may be extendible outside of the deck 5 of the drilling installation 1 by means of translation in the X-direction only. This drilling installation 1 is a jack-up platform having three or more legs 3 that are vertically adjustable with respect to the deck 5. The legs 3 are typically adjustable between an upper position in which the legs are extending mainly above the deck 5 and between a lower position in which the legs 3 mainly extend below the deck 5. In the upper position of the legs 3, the jack-up platform 1 may be towed or may sail to an offshore location. In the lower position of the legs 3 the legs may extend into the seabottom for anchoring of the jack-up platform 1. In the embodiment of FIG. 2, the legs 3 are in the lower position and the deck 5 is above the waterline 6.

The drilling floor 8 is the level where drilling operations, take place. It is also the level where handling and connecting of tubulars or drill strings is done. The tubulars are pipes with a standardized and/or predetermined length that are connected to each other to form a continuous drill string that can be lowered into the seabed for drilling a well. The drilling floor 8 is provided with a hole, not shown here, through which the drill string may travel downwardly into the earth bottom. Other equipment and/or installations that may be present on the deck 5 are not shown here.

Typically, for the exploration and/or production of an oil and/or gas field, multiple wells are drilled from a single location. The wells may fan out to spread over the reservoir. Therefore, multiple well strings 11 may be present. At an upper end of a well string 11, usually a well head is provided, not shown here. The well heads may be positioned above the water level on the production platform, a so-called surface wellhead, or may be positioned on the sea bed below the water level, a so-called subsea wellhead. Servicing, maintenance and/or well intervention operations during the production life of the well, take place via the wellhead.

At a level below the drilling floor 8, here mounted to the cantilever 17, a handling system 12 is provided. The handling system 12 is arranged for performing operations independent of the drilling operations on the drilling floor 8. The handling system 12 can handle equipment underneath the drilling floor 8 for example for maintenance or well intervention operations. The handling system 12 is provided with a handling element 13. The handling element 13 can be a guide element for guiding a wireline or a slackline or a coiled tubing etc. The handling element 13 may also be embodied as a cooperation element configured for cooperation with equipment to be handled. Such equipment may be a blowout preventer or a X-mas tree or a reel etc. The handling element 13 can thus be embodied as a lifting hook or a clamping mechanism.

As is widely known in the field of drilling, the drilling floor 8 is a hazardous area. There is being worked with heavy equipment, rotating machinery and dangerous fluids. Also, the drilling floor 8 is usually crowded with workers, drilling equipment, tubulars and/or drill string etc. Therefore, when maintenance or well intervention operations are to be performed, the drilling operations are interrupted and additional maintenance or well intervention equipment is being placed on the drilling floor. This is time consuming and may increase the risks on injuries and/or failures. By providing a handling system 12 mounted to the bottom side 17*f* or a lateral side 17*b*, 17*c*, or an aft side 17*d* of the cantilever 17, i.e. at a level below the drilling floor 8, maintenance and/or well intervention operations may be performed independent of the drilling operations. For example, the maintenance and/or well intervention operations may be performed simultaneously with the drilling operations, so the drilling operations does not need to be interrupted. Or, the maintenance and/or well intervention operations may be performed at the level below the drilling floor 8, even when there are no drilling operations, so there is no or limited interference of equipment and/or activities on the drilling floor 8. By separating these maintenance and/or well intervention operations from the drilling operations on the drilling floor, safety may be increased.

In the embodiment of FIG. 1, the handling element 13 is holding a coiled tubing unit 27, which is equipment that may be used for well intervention operations.

The handling element 13 of the handling system 12 is movable in a XY-plane underneath the drilling floor. Normally, such an XY-plane is approximately parallel to the bottom side 17*f* of the cantilever, at a level below the drilling floor 8. By providing the XY-movement, the handling system 12 can operate in the sometimes limited space that is available underneath the drilling floor 8. The handling element 13 and/or handling system 12 may be movable in the XY-plane, but the movement may be a translational and/or a rotational movement.

The drilling installation or here, jack-up platform, 1 is positioned adjacent a jacket or well platform 18. The well platform 18 comprises multiple wellheads 19 from which well strings 11 travel downwards to the wells. For drilling, maintenance, servicing and/or well intervention operations, the cantilever 17 may extend outside of the deck 5 over the well platform 18.

At a level below the drilling floor 8, a handling system 12 is provided with a horizontally movable handling element 13. Here, the handling system 12 is connected to a lateral side of the cantilever 17, while the horizontally movable handling element 13 is extendible underneath the cantilever 17. The handling system 12 is here embodied as a telescopic beam that is via a slewing gear 21 rotatable connectable to the cantilever 17. From the slewing gear 21 an upwardly extending connection arm 22 is provided. By providing a rotational joint, e.g. a slewing gear 21, and a horizontally extendible arm, e.g. a telescopic beam 20, a relatively large range can be obtained for the handling element 13.

A more detailed view of an embodiment of a telescopic beam 20 is given in FIG. 10. The telescopic beam 20 has an arm 20*a* that is translatable inside or outside of the arm 20*b*. At an end of the arm 20*a* the handling element 13 is provided, here as a lug. On the arm 20*b* a slewing gear 21 is provided such that the arm 20*b* is rotatable around a Z-axis, a direction transverse to the XY-plane in which the telescopic beam 20 is movable. From the slewing gear 21 upwards a connection arm 22 is mounted that provides for the connection with the drilling installation 1, e.g. with a side of a cantilever 17 on the drilling installation 1.

The handling element 13 is provided at the free end of the telescopic beam 20 and comprises in the embodiment of FIG. 1 a banana sheave 23 and a holding connection 24. Via the banana sheave 23, that can be adjustable in position itself, a wireline or coiled tubing or slackline or any other line or cabling 25 can be guided towards a well head 19 on the well platform 18. The line or cabling 25 typically is reeled onto a reel 26 that is preferably positioned on the deck 5 of the drilling installation 1. In an alternative position, the reel 26 may be positioned on a foldable texas deck 28 at a side of the platform deck 5. Various positions of the reel 26 on the deck 5 may be possible.

The handling element 13 here comprises a holding connection 24 to hold equipment 27, such as a well intervention stack, blowout preventer, a coiled tubing unit, or X-mas tree, while moving the equipment to and/or from the well platform 18. Such equipment 27 can be positioned on the platform 1 to be picked up by the handling system 12 and to be hoisted to the well platform 18. To that end, for example a texas deck 28 or foldable deck or other access platform can be provided. Here, a texas deck 28 is provided at an aft side of the jack-up platform 1. The deck 28 can be folded towards the side when it is not needed. The equipment 27 can be lowered onto the texas deck 28 by means of a crane available on the deck 5. Various embodiments are possible for the holding connection 24, for example a lifting hook, or a clamping mechanism, or a plate connection etc.

By providing the handling system 12, non-drilling operations such as servicing, maintenance, well intervention, work over etc. may be performed independent of the drilling operations. The drilling operations therefore do not need to be interrupted when such operations are being performed. Simultaneous operations to the drilling operations may become possible. This may provide for a more safe work environment as well as a more efficient use of the drilling installation. Eventually, the time the jack-up drilling installation 1 may be required for a specific well platform may be reduced.

The handling element 13 is horizontally movable to provide an optimal reach over the well platform and to position handling element 13 above a determined well head in order to be able to perform independent operations on that well. Advantageously, the reach of handling element 13 is larger than the moonpool area 10 to cover as much well heads on the well platform 18 as possible.

By providing a horizontally movable handling element 13 and/or handling system 12, the handling system 12 may be stored underneath the cantilever, or may be operable underneath the cantilever. Alternative embodiments such as a segmented beam, or a knuckle beam, or a drivable carriage are shown in FIG. 3, 5, 6, 7 or 8.

FIG. 2 shows a more detailed perspective view of the handling system 12 mounted to a lateral side of the cantilever 17, for example a starboard side or a port side, or an aft side. An advantage of mounting the handling system to the port or starboard side of the cantilever 17 may be that, when retracting the cantilever, the handling system 12 can come above the deck 5. There, the handling system 12 may disconnected from the cantilever 17 for storage on deck 5 or for maintenance.

Here, the handling system 12 is embodied as a segmented beam 20 having a first arm 14 and a second arm 15 that are hingedly connected to each other such that the handling element 13 at the free end 12*b* is movable in a horizontal plane. Here, the segmented beam 20 comprises two hingedly connected arms, but may also comprise three or more hingedly connected arms. Also, the handling system 12 may be a hybrid structure comprising of hingedly connected arms of which one arm may be embodied as a telescopic beam. The hinge joint may be provided by slewing gears or may be actuated by hydraulic cylinders.

In the embodiment of FIG. 2, the holding connection 24 of the handling element 13 is connected to a well intervention stack 27 that is positioned on the texas deck 28 for being hoisted to the platform 18. For positioning the equipment 27 onto the platform 18, it is advantageous that the handling system 12 is adjustable in the Z-direction and/or that lifting capacity is available on the handling system 12. The arms 14, 15 may be movable in the XY-plane to position the handling element 12 holding e.g. the well intervention stack or guiding e.g. the wireline to a position in accordance with the determined well, e.g. the well head of the well to be serviced or on which well intervention operations are to be performed. This position can be a position above the determined well head. Then, to lower the well intervention stack towards the well head, it is advantageous that the handling system 12 is adjustable in the Z-direction. By then adjusting the vertical position of the handling system 12, for example by means of hydraulic cylinders, the well intervention stack, or similar equipment, can be lowered and placed onto the well platform 18. Two hydraulic cylinders 29 are connected to the connection arm 22 to adjust the height of the connection arm 22 with respect to the cantilever 17. As such, the vertical position of the handling system 12 may be adjusted in a range provided by the strokes of the hydraulic cylinders 29. To guide the vertical movement of the connection arm 22, two brackets 30, here sliding bushes 30, are provided. In an embodiment, the lifting capacity may be provided by the hydraulic cylinders 29 as well. In another embodiment, a hoisting cable running over sheaves on or through the handling system 12 may be provided. The sliding bushes 30 may also provide for relative easy disconnection of the connection arm 22 and the handling system 12 with the cantilever 17. As such, the handling system 12 can be disconnected from the cantilever 17 and stored on the deck 5, for example during sailing and/or towing of the jack-up platform 1, or for maintenance purposes on the handling system 12.

For example, the well intervention stack 27 may be connected to the lifting hook 24 of the handling element 13 and may then, by movement of the handling element 13 in the horizontal XY-plane be positioned above the determined wellhead 19 of the well jacket 18. Then, the hydraulic cylinders 29 may be operated to lower the connection arm 22 and thus the handling system 12 with the connected equipment 27 towards the well jacket 18.

Figure 3:
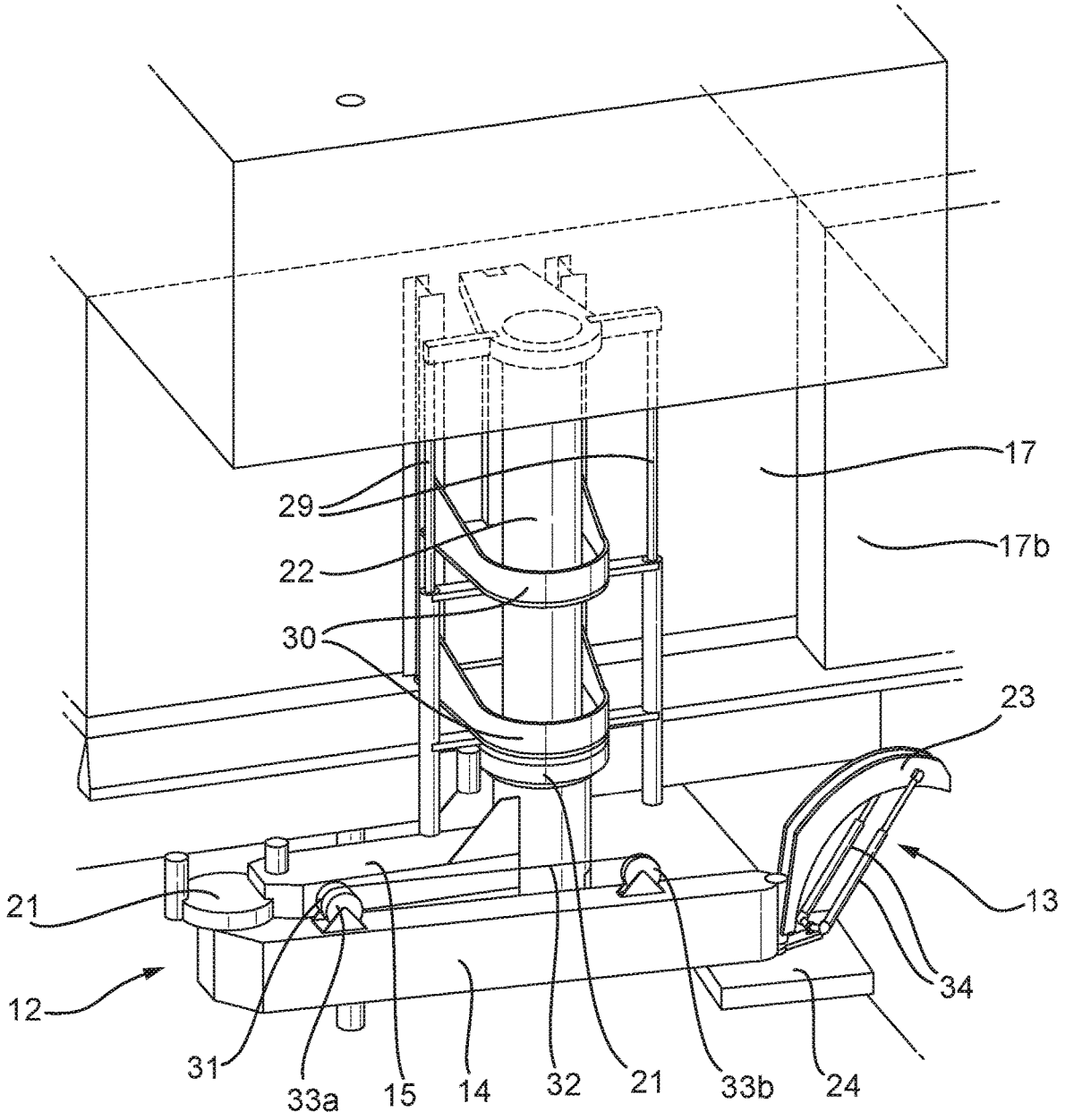
FIG. 3 shows a detailed view of the handling system of FIG. 2.

FIG. 3 shows the handling system 12 in a storage position at a lateral side of the cantilever 17. The handling system 12 is here too embodied as a segmented beam having a first beam 14 with the handling element 13 at its end and a second beam 15 connectable to the cantilever 17 via the slewing bearing 21 and the connection arm 22. The beams 14 and 15 are hingedly connected to each other via a slewing gear, but other hinge joints may be provided as well. Alternatively, the rotational movement between the two beams may be activated by hydraulic cylinders. The two cylinders 29 that are connected to the connection arm 22 may provide for vertical adjustment of the handling system 12 over the stroke of the cylinders. Alternatively and/or additionally, lifting capacity may be provided by the cylinders 29 and/or by a hoisting system 31 comprising a hoisting cable 32 running from winch 33*a* over sheaves 33*b* on the handling system 12. In this embodiment, the banana sheave 23 for guiding wires and/or cabling from a reel on the deck 5 to the well platform is adjustable by means of displacement mechanism 34, here cylinders 34.

Figure 4:
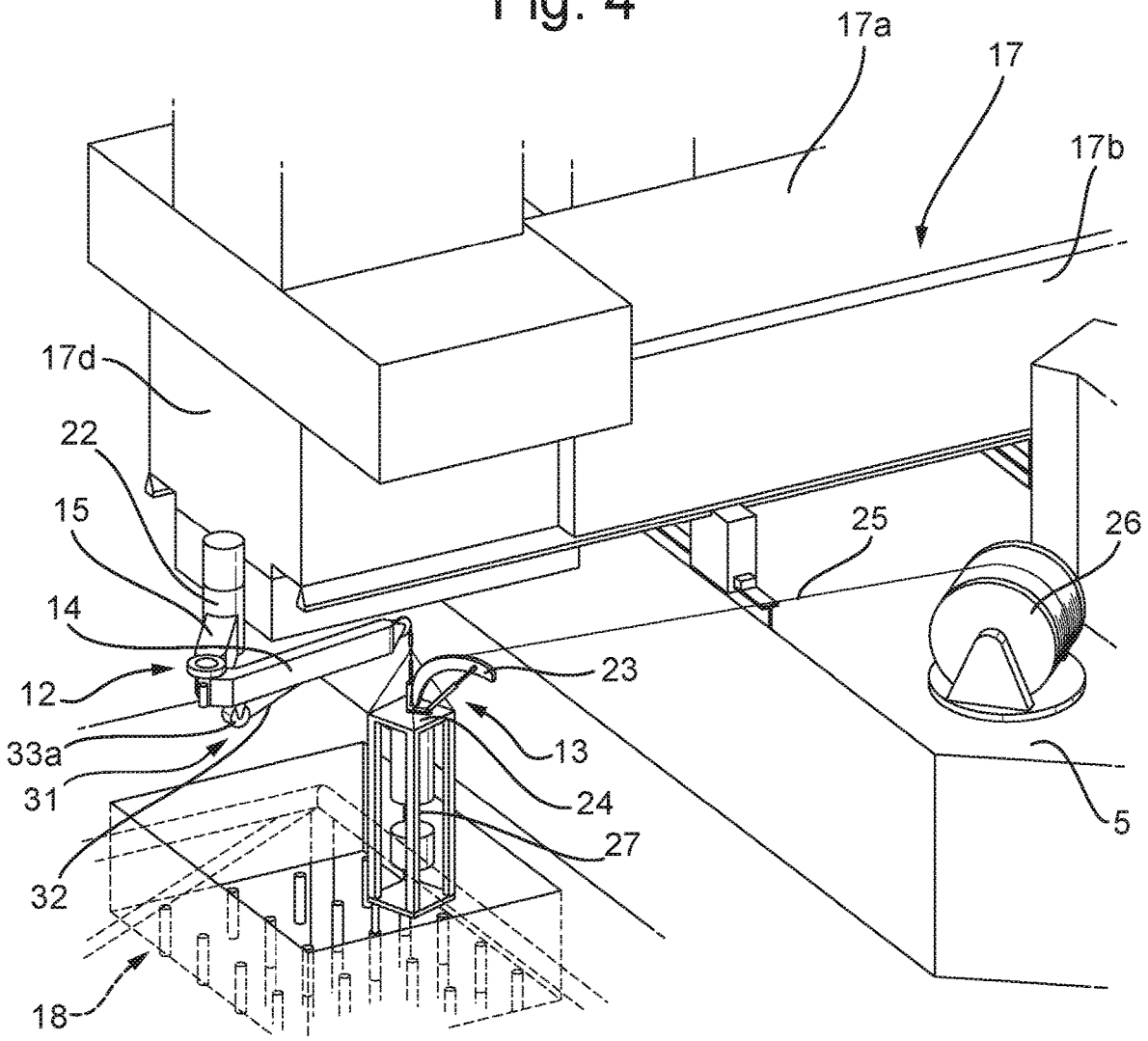
FIG. 4 shows an embodiment of the handling system positioned at an aft side of the cantilever.

FIG. 4 shows the handling system 13 connected to the aft side 17*d* of the cantilever 17. The lifting capacity for lifting the equipment 27 is in this embodiment as well provided by a hoisting cable 32 running from winch 33*a* over sheaves 33*b*. Here, the handing element 13, the lifting connection 24 and/or the banana sheave 23, is horizontally extendible together with the first beam 14 and the second beam 15 of the handling system 12 when the handling system 12 is operated to bring the equipment to the determined position. Once at the determined position, the equipment 27, here together with the lifting connection 24 is lowered to the well platform 18 by means of the hoisting system 31. By using the hoisting system 31, not the whole handling system 12 is vertically adjustable, but only the handling element 13. Typically, the positioning in the XY-plane may be done first, then the height in vertical direction may be adjusted when required. To enable independent operations, such as well intervention operations, a guide element 23 for guiding the wireline 25 from the reel 26 may be sufficient. Then, positioning of the handing element 13, and thus of the handling system 12, in the horizontal XY-plane, may allow for providing a relatively large reach over the well platform 18.

FIGS. 5*a* and 5*b* give an alternative embodiment of a handling system 12 at the aft side 17*d*. Here, the handling system 12 comprises a first beam 14 and a second beam 15 hingedly connected to each other by which the hinge joint is actuated with a hydraulic cylinder 38.

FIGS. 6*a* and 6*b* and FIGS. 7*a* and 7*b* show alternative embodiments of a handling system 12 mounted to the bottom side 17*f* the cantilever 17. The handling system 12 is provided as a carriage 39, that is movable over a ring-shaped rail 35. The rail 35 is arranged around the moonpool 10 so that operations through the moonpool 10 do not have to be interrupted. The carriage 39 is movable over the rail, and as such movable in a XYplane below the cantilever 17. In the embodiment of FIGS. 6*a* and 6*b*, carriage 39 is provided with an extension arm 40, e.g radially movable with respect to the carriage 39, extending the reach of the handling system 12 Further, a hoisting system 31 with sheaves 33 can be provided mounted onto the carriage for hoisting equipment. The handling element 12 may be provided at an end of the extension arm 40, as in FIG. 6*a*, or may be provided on the carriage 39. Alternative to a ring-shaped rail an XY-skidding system 36 may be provided configured around the moonpool 10, as embodied in FIGS. 8*a* and 8*b*. The handling element 13 can thus be positioned at determined positions reachable by the XY-skidding system.

FIG. 9 shows an alternative embodiment of the handling system 13, mounted to the aft end of the cantilever 17. The handling system 13 is here a segmented beam 20 having a first arm 14 and a second arm 15 hingedly connected to each other and actuatable with respect to each other by means of cylinders. The first arm 14 is here embodied as a bend beam which may allow for a relatively larger reach than with a straight first arm. The handling system 12 is via a slewing gear 21 and a connection arm 22 connected to the cantilever 17.

FIG. 11 shows an alternative embodiment of a handling system 12 mounted to a lateral side 17*b* of the cantilever 17. The handling system 12 here comprises an upwardly extending connection arm 22. At a lower end of the connection arm 22, a horizontally extendible arm 20 is connected to the connection arm 22. The horizontally extendible 20 is here connected via a slewing gear 21 to the connection arm 22, providing for 360 degrees of reach of the arm 20. The horizontally extendible arm 20 is here embodied as segmented beam 20 having a fore arm or first arm 14 and a base arm or second arm 15. At a free end 12*b* of the arm 20 is the handling element 13 provided. The handling system 12 further comprises a support structure 43 to which the connection arm 22 is mounted. The support structure 43 is mounted to the lateral side 17*b* of the cantilever. The support structure 43 comprises brackets 30 for guiding the connection arm 22. Adjacent the connection arm, and along the base arm 15 and fore arm 14, a stairway 45*a* and a walking bridge 45*b* is provided to allow workmen to access the handling system 12.

Here, the handling system 12 is mounted at a fixed position to the cantilever, i.e. the support structure 43 is fixedly connected to the cantilever 17. Alternatively, the support structure 43 can be horizontally extendible with respect to the cantilever 17, e.g. the support structure may be translatable over rails or tracks mounted to the cantilever. As such, the horizontal reach of the arm 20 may be extended and/or the handling system 12 may be additionally used to handle equipment to/from the main deck and well bay jacket.

In this embodiment, the connection arm 22 is vertically movable with respect to the support structure 43 and to allow for sliding movement of the connection arm, or pedestal, within the brackets, the brackets 30 can be embodied as sliding bushes 30. To provide for the vertical displacement of the connection arm 22 and horizontal arm 20, a rack-and-pinion displacement mechanism 44 can be provided, as shown in FIG. 13*a*.

FIG. 12 shows the connection arm 22 and the horizontal arm 20 disconnected from the support structure 43. Here, this is provided by opening the brackets 30. In the closed position of the brackets 30, the connection arm 22 is received and can be guided in the brackets 30. In the open position of the brackets 30, the connection arm 22 can be removed from the support structure. By providing the removable connection arm 22 and/or horizontal arm 20, this may facilitate maintenance and/or storage of the handling system during non-use of the handling system, e.g. to improve combined load characteristics of the cantilever or clearance to topside structures. The handling system 12 may then be stored e.g. on a temporary frame 46 on the deck 5.

FIG. 13*a* shows the rack-and-pinion displacement mechanism 44, comprising a rack 44*a* and pinions 44*b*. The rack 44*a* is here part of the support structure 43, whereas the pinions 44*b* are provided on the connection arm 22. The rack 44*a* may for example extend over approximately the height of the cantilever 17. By providing the rack-and-pinion displacement mechanism 44 the vertical displacement reach of the handling element 13 may become larger giving the handling system 12 more possibilities for handling equipment and performing operations. In this embodiment, the support structure 43 with brackets 30 receive the connection arm 22 and the connection arm 22 is adjustable with respect to the support structure 43.

In the embodiment of FIG. 13*a*, the handling element 13 here comprises a first handling part 13*a* for holding a wireline 48 and a second handling part 13*b* for holding a wireline stack. This is shown in more detail in FIG. 13*b*. In FIG. 13*b*, for reasons of simplicity, only the support structure 43 with the brackets 30 and the connection arm 22 is shown. The first and second arms 14, 15 of the segmented arm 20 are only schematically shown. The wireline 48 is guided through the connection arm 22, which is shown in more detail in FIG. 14. Then, the wireline 48 is guided along or through the arms 15, 14 of the horizontally extendible arm 20. Thereto, sheaves or rollers 58*a*, 58*b*, 58*c* are provided. The first handling part 13*a* of the handling element 13 is here embodied as a sheave for guiding the wireline 48. The second handling part 13*b* of the handling element 13 is here embodied as a hoist element for holding second equipment, such as a wireline stack. The hoist element can be a hook, or a ring, or a specific structure to connect the wireline stack to the hoisting line or lines. It is also possible to provide for a hook or a ring or another specific connection per hoisting line. As such, the handling element is dedicated for a determined operation, here a wireline operation. Also shown in FIGS. 13*a* and 13*b* is that the handling system 12 is provided with a further handling element 13*ii*, here a hoist block. So, multiple handling elements 13 may be provided, wherein each handling element may be dedicated for a determined operation. Alternatively, the handling elements or parts thereof may be exchangeable depending on the operation to be performed.

A wireline stack or wireline rig-up consists of a tool string composed of for example a stuffing box on top, a lubricator and a blow out preventer. For wireline operations, the lower end of the wireline rig-up is connected to the well head or X-mas tree, wireline is guided into the rig-up from the guiding sheave 13*a* and runs through the rig-up into the drill pipe. Here, the rig-up second handling part 13*b* is provided with a dual hoist line/cable 57 running on a dual drum 47. The two hoist cables 57 can be connected to an outer edge of a top side of the rig-up and can be lifted and lowered by the dual drum 47. The first handling part, sheave 13*a*, guiding the wireline 48, is positioned between these cables 58, and as such, the wireline can be guided relatively easy to the center of an entrance of the wireline rig-up. Thus, the wireline rig-up can be held under approximately constant tension during wireline operations, which is advantageous, as such a wireline rig-up typically collapses under its own weight, so by tensioning it with a hoist line provided on the handling system, additional hoisting activity and use of additional equipment can be obviated. Also, the wireline rig-up can be pulled up and held closely to the first handling part guiding the wireline, which saves space compared to normal wireline operations.

The dual drum winch 47 is here provided near a knuckle of the knuckle beam. The further handling element 13*ii*, is here embodied as a hoisting block, suitable for loads such as a container, X-mas tree or well intervention stack, with a hoisting line 58 running on a winch or drum 59.

As shown in FIG. 13*c*, the handling element 13 is here configured for specific well intervention operations like coiled tubing. Such a handling element 13 comprises a guiding arch and/or a mechanism for holding a well intervention stack or coiled tubing unit 27. The handling element 13 here is provided with clamping elements that clamp around a holding block of the coiled tubing unit 27. The handling system can be arranged with at least one handling element and can be arranged with handling elements suitable for different operations, e.g. a handling element suitable for wireline operations as well as a handling element suitable for coiled tubing.

Advantageously, a wireline 48 is guided through the handling system 12, as shown in FIG. 14. The wireline reel 49 is here mounted on the lateral side 17*b* of the cantilever 17. The wireline 48 is guided through the connection arm 22 and is then guided along the horizontal arm 20 until it reaches the handling element 13 to be guided into a drill pipe through the wireline rig-up and well head. By routing the wireline internally in and along the handling system 12, forces on the wireline can be reduced and the wireline can be more protected from external influences, which may improve the lifetime of the wireline.

FIG. 15*a* shows another embodiment of a rack-and-pinion displacement mechanism 44. In the embodiment of FIG. 12, the vertical displacement is although relatively large, nevertheless limited by the position of the fixed brackets 30. Here, in the embodiment of FIG. 15*a*, the brackets 30 are connected to the connection arm 22 and the brackets 30 are provided with the pinions that are displaceable over a rack of the support structure 43. The brackets 30, as part of the support structure 43, now form a carriage 50 in which the connection arm 22 is received for supporting the connection arm 22. By displacing the carriage 50 along the rack, the connection arm 22 and the horizontal arm 20 also move along. Thus, the vertical displacement reach of the handling system 12 may be increased. Even, now equipment such as container can be lifted and taken on board of the drilling installation 1 e.g. during retracting of the cantilever. Also in this embodiment, the brackets 30 can be adjusted to the open position to allow the connection arm 22 to be removable from the support structure 43 for storage and/or maintenance purposes. Alternatively, only the horizontal arm may be disconnected, at the slewing gear, from the connection arm. By disconnecting the connection arm and/or horizontal arm, the combined load characteristics of the cantilever may be improved in some situations. Also, in certain situations, the clearance to the deck may be improved. The connection arm or pedestal 22 is top-mounted to the side of the cantilever 17, and the boom or horizontal arm 20 can slew 360° around the lower end of the pedestal. A top view of the support structure 43 with brackets 30 and connection arm 22 is shown in FIG. 15*b*. The pinions 44*b* are connected to the brackets 30 and are movable with respect to the rack 44*a*. The rack 44*a* is on the fixedly mounted part of the support structure 43, whereas the brackets 30 form the movable part of the support structure 43 receiving the connection arm 22. The fixedly mounted part of the support structure 43 comprises at least a U-shaped guide 60, wherein the rack 44*a* is provided on one leg of the U-shape. Between the legs of the U-shaped guide rollers 61 and 62 are provided to center the carriage 50 with the pinions 44*b* onto the racks 44*a* during displacement and to transfer loads to/from the support structure 43. The pinions 44*a* can be driven by any suitable driving source, e.g. electrical motor, hydraulic drive etc.

Instead of a rack-and-pinion displacement mechanism, a winch for hoisting the connection arm vertically along the support structure 43 may be provided, or the already mentioned hydraulic cylinders.

The guide 60 can have various embodiment, such as T-shaped with three rail enclosing wheels per set or U-shaped rail with two wheels enclosed by the rails, as in FIG. 15*b*. The front side wall of each U-shaped vertical guide is provided with a rack to interact with one of the pinions. Alternatively and in case of a T-shaped rail, a central rack can be attached to the support structure 43 to interact with at least one pinion which is mounted to the brackets 30 or carriage 50 or the connection arm 22.

FIG. 16*a* shows a sequence for handling of material from below the cantilever 17 to the main deck 5. In FIG. 16*a*, drilling operations are being performed from the drilling floor and the handling system 12 is performing, simultaneous to the drilling operations, the handling of a load 63 underneath the cantilever 17. The horizontally movable arm 20, for example, a segmented beam 20, is pivoted in a horizontal XY-plane until the load 63 is directed towards the drilling installation 1 as shown in FIG. 16*b*, preferably the arm 20 is aside the cantilever 17. Then, shown in FIG. 16*c*, the handling system 12 is moved vertically upwards, until the load 63 receives sufficient clearance with the main deck 5. Here, the connection arm 22 is moved vertically up with respect to the support structure 43 and the brackets 30. Further, the arm 20 can extend until the load 63 reaches above the main deck 5 as shown in FIG. 16*c*. Horizontal arm 20 can be moved and stretched out such that the arm 20 reaches over the main deck 5. A container or other equipment 63 can placed on deck 5 by lowering arm 20, via the vertical displacement mechanism 34, or by using the hoist of the handling element 13. This operational sequence can be performed independent of the operations on the drilling floor, and the operations on the drilling floor do not need to be interrupted for handling material or equipment between the jacket and the main deck 5. By using the handling system 12 for this equipment handling, main deck crane activity can be reduced.

FIG. 17 gives an alternative to the step of FIG. 16*c*. Here, the cantilever 17 is being retracted to a position substantially above the main deck 5. During retraction, the arm 20 of the handling system 12 is aside the cantilever 17 and is being moved vertically upward until the load 63 has sufficient free space above the deck 5 and obstacles. As such, the handling system 12 can be used to take additional equipment during retraction of the cantilever, by which, again, main deck crane activity may be reduced.

Alternatives are possible to extend the vertical displacement of the handling system 12. For example, the rack on which the pedestal or connection arm can be displaced can be extended to above or below. In another example the boom or arm segment(s) can be pivotable in a vertical plane, e.g. while positioned alongside the cantilever. Thereto, horizontal hinge(s) and suitable actuators can be provided. In another example, the boom fore arm may be equipped with an additional arm segment which is pivotable in the vertical plane around a horizontal hinge and then can be tilted up by any type of suitable actuator.

For the purpose of clarity and a concise description, features are described herein as part of the same or separate embodiments, however, it will be appreciated that the scope of the invention may include embodiments having combinations of all or some of the features described. It may be understood that the embodiments shown have the same or similar components, apart from where they are described as being different.

For example, it may be understood that the handling system as described above may have various embodiments as well as combinations of elements of these embodiments. Also, it may be understood that the handling system may be positioned at a lateral side or at an aft side or at a bottom side of the cantilever, irrespective of the embodiment of the handling system.

Other aspects of the embodiments are a drilling installation comprising a derrick and a drilling floor for performing drilling operations, wherein the drilling floor is on a cantilever extendible outside of the drilling installation and the derrick is positioned over the drilling floor; further comprising an independent operations handling system arranged for handling equipment underneath the cantilever independent of the drilling operations on the drilling floor; wherein the independent operations handling system comprises a handling element for cooperation with the equipment to be handled; wherein the handling element is movable in a XY-plane underneath the cantilever.

In another aspect, the handling system comprises a horizontally extendible arm with the handling element at a free end of the arm.

In a further aspect, the handling element is configured for guiding equipment such as a wireline and/or coiled tubing, for example as a banana sheave.

As another aspect, the handling element is configured for holding equipment, such as a well intervention stack, a blow-out-preventer and/or a X-mas-tree, for example as a lifting hook or a clamping mechanism.

In another embodiment, the handling system and/or the handling element further is arranged for movement in the Z-direction.

In a further embodiment, the handling system further is provided with hoisting means.

In another embodiment, the handling system is mounted to a bottom side and/or a lateral side of the cantilever.

In a further embodiment, the drilling installation comprises a reel on the deck of the drilling installation facing the handling system, wherein the reel is arranged for comprising equipment such as a wireline or coiled tubing to be handled by the handling system or further comprises an equipment station at a side of the drilling installation facing the handling system, for example configured as a foldable texas deck.

In another example, the handing system is removable connected to the cantilever for storage on the drilling installation during non-use of the handing system.

Another aspect is the cantilever for mounting on a drilling installation, wherein the cantilever is provided with a handling system at a lower end thereof for handling equipment independent of drilling operations, wherein the handing system comprises a handling element that is arranged for movement in a XY-plane underneath the cantilever.

Another aspect is the handling system configured for mounting to a cantilever for handing equipment underneath the cantilever, comprising a handing element for cooperation with the equipment, wherein the handing element is arranged for movement in a XY-plane.

In another embodiment, the handling system comprises a segmented beam extending in the XY-plane, wherein the handling element is arranged on a free end of the segmented beam.

In a further embodiment, an end of the segmented beam opposite of the free end is connectable to the cantilever.

In yet a further embodiment, the connectable end is adjustable with respect to the cantilever in a Z-direction transverse to the XY-plane.

In a yet another embodiment, the handling system is disconnectedly mountable to the cantilever.

A further aspect is a method for performing operations on wells independent of drilling operations on a drilling installation with a cantilever extendible outside of the drilling installation, comprising providing a handling system for handing equipment to perform the independent operations, wherein the handling system comprises a handling element for cooperation with the equipment, moving the handling element in an XY-plane underneath the cantilever to a position in accordance with a determined well head and/or further moving the handing system and/or the handing element in a Z-direction downwards for lowering equipment, such as a well intervention stack or a blowout preventer to the determined well head.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage.

Many variants will be apparent to the person skilled in the art. All variants are understood to be comprised within the scope of the invention defined in the following claims.

The invention claimed is:

1. Cantilever for mounting on a drilling installation comprising a drilling floor for performing drilling operations, wherein the cantilever is extendible outside of the drilling installation, said cantilever comprising:

an independent operations handling system arranged for handling equipment underneath the cantilever independent of the drilling operations on the drilling floor;

wherein the independent operations handling system comprises a handling element for cooperation with the equipment to be handled;

wherein the handling element is movable underneath the cantilever;

wherein the handling system is mounted to a side of the cantilever, and wherein the drilling floor is on the cantilever.

2. Cantilever according to claim 1, in which the handling system comprises a support structure for mounting to the side of the cantilever.

3. Cantilever according to claim 1, wherein the handling system is removably connectable to the cantilever.

4. Cantilever of claim 1, wherein the cantilever is translatable in an X-direction in an XY-plane that is parallel to the drilling floor.

5. Cantilever of claim 4, wherein the cantilever is rotatable.

6. Cantilever of claim 4, wherein the cantilever is translatable in both the X-direction and a Y-direction in the XY-plane.

7. Cantilever of claim 6, wherein the cantilever is rotatable.

8. Cantilever for mounting on a drilling installation, wherein the cantilever comprises a drilling floor for performing drilling operations, wherein the cantilever is extendible outside of the drilling installation, said cantilever further comprising:

an independent operations handling system arranged for handling equipment underneath the cantilever independent of the drilling operations on the drilling floor;

wherein the independent operations handling system comprises a handling element for cooperation with the equipment to be handled;

wherein the handling element is movable underneath the cantilever;

wherein the handling system is mounted to a side of the cantilever, and wherein the handling system is vertically adjustable at least between a first position in which the handling element is movable underneath the cantilever, and a second position in which the handling element is aside the cantilever.

9. Cantilever for mounting on a drilling installation, wherein the cantilever comprises a drilling floor for performing drilling operations, wherein the cantilever is extendible outside of the drilling installation, said cantilever further comprising:

an independent operations handling system arranged for handling equipment underneath the cantilever independent of the drilling operations on the drilling floor;

wherein the independent operations handling system comprises a handling element for cooperation with the equipment to be handled;

wherein the handling element is movable underneath the cantilever;

wherein the handling system is mounted to a side of the cantilever, wherein the handling system comprises a support structure for mounting to the side of the cantilever, and wherein the handling system further comprises a connection arm that is connected to the support structure, wherein at a lower end of the connection arm a horizontally extendible arm is provided, on which, at a free end thereof, the handling element is arranged, and/or wherein the connection arm is vertically adjustable with respect to the support structure.

10. Cantilever according to claim 9, wherein the handling element is vertically adjustable with respect to the horizontally extendible arm.

11. Cantilever according to claim 9, wherein the handling system comprises a further handling element, and/or wherein the further handling element is arranged onto a free end of the horizontally extendible arm.

12. Cantilever according to claim 9, wherein the connection arm is configured for receiving a wireline therethrough and/or an arm of the handling system is configured for guiding a wireline alongside or therethrough towards the handling element.

13. Cantilever according to claim 9, wherein the connection arm is removably connectable to the support structure.

14. Cantilever for mounting on a drilling installation, wherein the cantilever comprises a drilling floor for performing drilling operations, wherein the cantilever is extendible outside of the drilling installation, said cantilever further comprising:

an independent operations handling system arranged for handling equipment underneath the cantilever independent of the drilling operations on the drilling floor;

wherein the independent operations handling system comprises a handling element for cooperation with the equipment to be handled;

wherein the handling element is movable underneath the cantilever;

wherein the handling system is mounted to a side of the cantilever, and wherein the handling element comprises a first handling part for handling a first equipment and a second handling part for handling a second equipment for dedicated independent operations.

15. Cantilever according to claim 14, wherein the first handling part is a sheave configured for handling a wireline and the second handling part is a hoist configured for hoisting wireline equipment for wireline operations, and/or wherein the second handling part of the handling element comprises a dual hoisting line for holding at least one hoist element.

16. Cantilever for mounting on a drilling installation, wherein the cantilever comprises a drilling floor for performing drilling operations, wherein the cantilever is extendible outside of the drilling installation, said cantilever further comprising:

an independent operations handling system arranged for handling equipment underneath the cantilever independent of the drilling operations on the drilling floor;

wherein the independent operations handling system comprises a handling element for cooperation with the equipment to be handled;

wherein the handling element is movable underneath the cantilever;

wherein the handling system is mounted to a side of the cantilever, wherein the handling system comprises a support structure for mounting to the side of the cantilever, and wherein the handling system is arranged for guiding a wireline therethrough.

17. Drilling installation comprising the cantilever according to claim 1.

18. Drilling installation comprising a derrick and a drilling floor for performing drilling operations, wherein the drilling floor is on a cantilever extendible outside of the drilling installation and the derrick is positioned over the drilling floor; further comprising:

an independent operations handling system, connected to the cantilever, and arranged for handling equipment underneath the cantilever independent of the drilling operations on the drilling floor such that drilling operations can continue uninterrupted by the handling of the equipment;

wherein the independent operations handling system comprises a handling element for cooperation with the equipment to be handled;

wherein the handling element is movable in a XY-plane underneath the cantilever;

wherein the handling system comprises a horizontally movable arm with the handling element at a free end of the arm.

19. Drilling installation according to claim 18, wherein the handling element is configured for guiding and/or holding equipment.

20. Drilling installation according to claim 19, wherein the handling system and/or the handling element further is arranged for movement in the Z-direction, and/or wherein the handling system further is provided with hoisting means.

21. Drilling installation according to claim 18, wherein the handling system is mounted to a bottom side and/or a lateral side of the cantilever.

22. Drilling installation according to claim 18, further comprising a reel on the deck of the drilling installation facing the handling system, wherein the reel is configured for providing equipment to be handled by the handling system.

23. Drilling installation according to claim 18, wherein the handling system is removably connected to the cantilever for storage on the drilling installation during non-use of the handling system.

* * * * *